US009640350B2

(12) United States Patent
Stoving et al.

(10) Patent No.: US 9,640,350 B2
(45) Date of Patent: May 2, 2017

(54) MODULAR SWITCHGEAR INSULATION SYSTEM

(71) Applicants: Paul Newcomb Stoving, Oak Creek, WI (US); Robert Raymond Schuetz, West Allis, WI (US); Rose Ellen Weisburgh, Milwaukee, WI (US); William Robert Luoma, Franklin, WI (US); Joseph Allen Carmichael, Trevor, WI (US); Brian Andrew Korves, St. Francis, WI (US); Laurence James Geist, Mukwonago, WI (US); Joseph Michael Hren, New Berlin, WI (US)

(72) Inventors: Paul Newcomb Stoving, Oak Creek, WI (US); Robert Raymond Schuetz, West Allis, WI (US); Rose Ellen Weisburgh, Milwaukee, WI (US); William Robert Luoma, Franklin, WI (US); Joseph Allen Carmichael, Trevor, WI (US); Brian Andrew Korves, St. Francis, WI (US); Laurence James Geist, Mukwonago, WI (US); Joseph Michael Hren, New Berlin, WI (US)

(73) Assignee: COOPER TECHNOLOGIES COMPANY, Houston, TX (US)

( * ) Notice: Subject to any disclaimer, the term of this patent is extended or adjusted under 35 U.S.C. 154(b) by 0 days.

(21) Appl. No.: 14/627,821

(22) Filed: Feb. 20, 2015

(65) Prior Publication Data

US 2015/0235790 A1 Aug. 20, 2015

Related U.S. Application Data

(60) Provisional application No. 61/942,293, filed on Feb. 20, 2014.

(51) Int. Cl.
*H01H 33/666* (2006.01)
*H01H 33/662* (2006.01)
*H01H 33/02* (2006.01)

(52) U.S. Cl.
CPC ..... *H01H 33/6661* (2013.01); *H01H 33/027* (2013.01); *H01H 33/6662* (2013.01);
(Continued)

(58) Field of Classification Search
CPC ..... H01H 33/66261; H01H 2033/6623; H01H 33/66207; H01H 2033/6613;
(Continued)

(56) References Cited

U.S. PATENT DOCUMENTS 3,586,801 A * 6/1971 Saito ..... H01H 33/66261 200/305
3,590,184 A 6/1971 Wachta et al.
(Continued)

FOREIGN PATENT DOCUMENTS

KR 101080673 B1 11/2011
WO 9904472 A1 1/1999
(Continued)

OTHER PUBLICATIONS

The International Search Report and Written Opinion From Corresponding Application No. PCT/US2015/016880, mailed Jul. 9, 2015 (6 sheets).
(Continued)

*Primary Examiner* — Truc Nguyen
(74) *Attorney, Agent, or Firm* — King & Spalding LLP

(57) ABSTRACT

An insulated switchgear module is disclosed. In one example, the module comprises a vacuum interrupter, current exchange assembly, and end conductors disposed within an insulated housing. The insulated housing further comprises a tank containing an actuator mechanism for actuating
(Continued)

the current exchange assembly. An insulating tray within the housing separates the vacuum interrupter from the components in the tank. The insulated tray has a shape that corresponds with the shape of the vacuum interrupter and the shape of the housing.

28 Claims, 21 Drawing Sheets

(52) U.S. Cl.
CPC ..... *H01H 2033/66276* (2013.01); *Y10T 29/49105* (2015.01)

(58) Field of Classification Search
CPC ..... H01H 2033/66269; H01H 2033/66276; H01H 33/6606; H01H 2033/66284; H01H 33/6661; H01H 11/00; H01H 1/5822; H01H 1/5833
See application file for complete search history.

(56) References Cited

U.S. PATENT DOCUMENTS 3,708,638 A * 1/1973 Mitchell ..... H01H 33/143 218/118
4,079,217 A * 3/1978 Oeschger ..... H01H 33/66 218/135
4,568,804 A 2/1986 Luehring
5,269,055 A 12/1993 Kessi
5,576,523 A * 11/1996 Meyer ..... H02B 13/0352 200/17 R
5,585,611 A 12/1996 Harvey et al.
5,597,992 A * 1/1997 Walker ..... H01H 33/6606 218/121
5,747,765 A 5/1998 Bestel et al.
5,808,258 A 9/1998 Luzzi
5,917,167 A 6/1999 Bestel
6,130,394 A 10/2000 Högl
6,172,317 B1 1/2001 Wristen
6,310,310 B1 10/2001 Wristen
6,410,867 B1 * 6/2002 Meyer ..... H02B 13/045 200/49
6,414,257 B1 7/2002 Luscan
6,495,785 B1 * 12/2002 Meyer ..... H01H 33/02 218/43
6,747,234 B2 6/2004 Traska et al.
6,760,206 B2 7/2004 Daharsh et al.
6,828,521 B2 12/2004 Stoving et al.
6,867,385 B2 3/2005 Stoving et al.
6,946,614 B2 * 9/2005 McKean ..... H01H 33/027 218/120
7,148,441 B2 12/2006 Daharsh et al.
7,310,221 B2 12/2007 Lammers
7,473,863 B2 1/2009 Schreiber et al.
7,488,916 B2 2/2009 Muench et al.
7,772,515 B2 8/2010 Stoving et al.
7,820,926 B2 10/2010 Kowalyshen et al.
7,852,180 B2 12/2010 Gentsch et al.
8,450,630 B2 5/2013 Stoving
D722,030 S 2/2015 Opfer et al.
2004/0050820 A1 * 3/2004 McKean ..... H01H 33/027 218/154
2005/0082260 A1 4/2005 Martin
2005/0092713 A1 * 5/2005 Chyla ..... H01H 1/5833 218/118
2006/0011589 A1 1/2006 Hering et al.
2006/0231529 A1 * 10/2006 Daharsh ..... H01C 7/12 218/136
2008/0000879 A1 * 1/2008 Steffens ..... H01H 1/62 218/124
2010/0170774 A1 7/2010 Einschenk et al.
2010/0314357 A1 * 12/2010 Kobayashi ..... H01H 33/66207 218/140
2011/0155697 A1 * 6/2011 Lee ..... H01H 33/022 218/140
2013/0092658 A1 * 4/2013 Ache ..... H01H 33/66207 218/139
2013/0126479 A1 5/2013 Shang
2013/0213938 A1 8/2013 Bramhapurikar et al.
2013/0228432 A1 9/2013 Borgstrom et al.
2013/0284704 A1 * 10/2013 Gentsch ..... H01H 33/666 218/140
2014/0138357 A1 * 5/2014 Kasza ..... H01H 11/00 218/134
2015/0102013 A1 * 4/2015 Yamazaki ..... H01H 33/66207 218/3
2015/0180224 A1 6/2015 Arioka et al.
2015/0235790 A1 8/2015 Stoving et al.

FOREIGN PATENT DOCUMENTS

WO 0041199 A1 7/2000
WO 0150561 A1 7/2001

OTHER PUBLICATIONS

Slade, Paul G., "The Vacuum Interrupter: Theory, Design and Application", CRC Press, 2008 (summary only), 3 sheets.

* cited by examiner

MODULAR SWITCHGEAR INSULATION SYSTEM

CROSS REFERENCE TO RELATED APPLICATIONS

The present application claims priority under 35 U.S.C. §119(e) to U.S. Provisional Patent Application No. 61/942,293, titled "Modular Switchgear Insulation System," and filed on Feb. 20, 2014. The entire content of the foregoing application is incorporated herein by reference.

TECHNICAL FIELD

The present disclosure relates generally to switchgear and specifically to switchgear that is modular and insulated.

BACKGROUND

Utility companies typically distribute power to customers using a network of power lines, cables, transformers, and switchgear. Distribution switchgear is medium voltage (e.g. 1 kV-38 kV) equipment used to control the flow of power and current through the distribution network by opening and closing under established criteria, for instance, tripping open when a damaging high-current fault occurs within the system. Distribution switchgear typically consists of a current interrupter, such as a vacuum interrupter, a mechanism to open and close the current interrupter, a sensing system to detect the status of the distribution network, and insulation encompassing some or all of these components. The sensing system may include a current sensor, a voltage sensor, or various other types of sensors.

Various exemplary vacuum interrupters, sometimes called vacuum bottles or vacuum tubes, are described in U.S. Pat. No. 8,450,630. One such exemplary vacuum fault interrupter 100 is shown in FIG. 1. A contact 102 is movable relative to a stationary contact 101. They are contained inside a sealed envelope consisting of an insulator 115, typically a ceramic, endcaps 111 and 112, and a flexible bellows 118, which allows the motion of the movable contact 102 on the same axis as the insulator 115 without loss of the seal. Air is removed from this envelope, leaving a deep vacuum 117, which has a high voltage withstand, and desirable current interruption abilities.

Current enters the vacuum interrupter through the stationary end connection 107. End connection 107 may be made from one or more pieces. Inside the vacuum interrupter, current is directed through a stationary coil segment 105, which has slots cut into it that force current to follow a substantially circumferential path before entering the stationary contact 101. Likewise, upon exiting the movable contact 102, current is again forced to follow a substantially circumferential path by slots cut into movable coil segment 106, before exiting the vacuum interrupter via moving end rod 108. End rod 108 may be constructed out of more than one piece. Current flow may also be reversed. There may also be one or more contact backings 103, 104, between the coil segments 105, 106 and the contacts 101, 102. Both the contact backings 103, 104, and the slots cut into the coil segments 105, 106, may be used to generate a magnetic field parallel to the main axis of the contacts 101, 102, and the insulator 115. The axial magnetic field may be used to control electrical arcing that occurs when the contacts are separated. Other arc control methods may be used as well. The end rods 107, 108, and the coil segments 105, 106 are typically made of copper. Reinforcing rods 109, 110, may be added to reinforce and strengthen the structure, and may be made of any applicable structural material such as stainless steel. One or more threads may be added at either end to facilitate either the electrical connection to the distribution network or the mechanical connection necessary to open the interrupter, for instance, threaded insert 119, which may be made out of any applicable structural material, such as stainless steel. Endcaps 111, 112 may also be shaped to protect any triple joints that may exist at either end of insulator 115 from high electrical stress. Alternately, separate end shields may be provided. Center shield 116 is also provided to grade electrical stress and protect insulator 115 from arcing that may occur when the contacts open. Center shield 116 may be mounted by being brazed to retaining ring 120 that sits in groove 121 in insulator 115.

An exemplary insulation system is shown in FIG. 2 (prior art). Insulation system 200 uses a modified vacuum interrupter 100'. Compared with vacuum interrupter 100, modified interrupter 100' has a hollow moving rod 208 to accommodate a contact pressure spring 231 as described with respect to FIG. 12 of in U.S. Pat. No. 6,867,385. Contact pressure springs provide opening energy to operating mechanisms while also providing contact closing force and allowing for vacuum interrupter contact erosion. Contact pressure spring 231 is held in place with spring coupler 248 by pin 247. Vacuum interrupter 100' has also been modified to add a piston 232 for holding a louvered contact band sliding style current exchange. This band slides along the inside diameter of current exchange housing 233. Other current exchanges may be used as well, for instance, the flexible wires shown in U.S. Pat. No. 5,597,992. The contacts of vacuum interrupter 100' are shown as if open at full gap.

Vacuum interrupter 100' is encapsulated in a solid dielectric 234, for instance epoxy. Buffer layer 235 may be used to absorb differences in the coefficient of thermal expansion between the insulator 115 of vacuum interrupter 100' and the solid dielectric 234. Buffer layer 235 may be an expanded compliant material, as described in U.S. Pat. No. 5,917,167, for instance, silicone rubber. End conductors 236, 237 thread into the stationary end 107 of the vacuum interrupter and into the outside diameter of current exchange housing 233, respectively, to carry current into and out from vacuum interrupter 100'.

Current transformer 238 may wrap around end conductor 237, and may be mounted to base 240 via tube 239, as described in U.S. Pat. No. 6,760,206. Current transformer 238 is used to detect the amount of current flowing through end conductor 237 and vacuum interrupter 100'. The output wires from current transformer 237 may be routed through tube 239.

Operating rod 241 may be connected to contact pressure spring 231 and used to open and close vacuum interrupter 100' by moving contact 102 relative to stationary contact 101 and base 240. While contact pressure spring 231 is shown nested inside the moving rod 208, it could also be embedded in operating rod 241 or be elsewhere in the mechanical system. Operating rod 241 may also contain one or more resistors 242 as part of a voltage sensor, as described in U.S. Pat. No. 7,473,863.

Solid dielectric 234 includes an operating cavity 243, which allows motion of operating rod 241 relative to base 240 by an operating mechanism (not shown). Cavity 243 is typically air filled, but may also be filled with other insulating fluids, for instance: mineral oil or sulfur hexalluoride (SF6). Insulating rubber plug 244 may increase the dielectric strength of cavity 243 by surrounding the open end of current exchange housing 233, as described in U.S. Pat. No. 6,828,521 and reducing discharges. Grading shield 245 may completely or partially surround cavity 243, and reduce electrical stress in cavity 243 as a result of a close proximity of grounded current transformer 238 and the high voltage end of operating rod 241, as described in U.S. Pat. No. 7,148,441. Drip sheds 246 may protect the operating cavity 243 from condensation, as described in U.S. Pat. No. 5,747,765.

Similarly, one or more horizontal sheds 251 or vertical sheds 252 may protect insulation system 200 from environmental influences, such as: condensation, pollution, arcing, or electrical creep. One or more horizontal sheds 251 or vertical sheds 252 may also serve to dissipate heat.

While insulation system 200 provides a robust method of insulating a vacuum interrupter and various sensors, there are disadvantages to the system.

Insulation system 200 is typically made by encapsulating epoxy resin around the various components, and then allowing the epoxy to cure and solidify. Voltage classes are predetermined based on the size of the mold: smaller molds are used for lower voltage classes and inserts are typically added to the mold to increase its size for higher voltage classes. Furthermore, the choice of vacuum interrupter type, conductor size, and current transformer type must also be made prior to encapsulation. Thus, once a specimen is molded, it is impossible to change voltage or current ratings, or any other options. Thus, insulation system 200 is not flexible per production demands.

Likewise, if damage occurs to any component, for instance: horizontal shed 251 is chipped, the entire insulation system 200 must be discarded, even if the remaining components are still in good condition. Insulation system 200 is not flexible per servicing demands.

Furthermore, while insulation system 200 allows detection of voltage at one of the two end conductors via operating rod 241 and resistor 242, it does not allow detection at the opposite end. A resistive or capacitive sensor passing from end conductor 236 would pass near vacuum interrupter 100' and current exchange housing 233. This would result in a high electrical stress in insulation system 200, where two different voltages would pass by each other. Furthermore, a high amount of electrical cross-talk might then occur as a result of a capacitance coupling that may exist between the two voltages, resulting in a loss of accuracy of both voltage output signals.

It is desirable to provide an insulating system that would allow voltage and current ratings, as well as other options, to be determined after the insulation system is manufactured. It is desirable to have an insulating system that allows replacement of damaged components without discarding and replacing the entire system. It is also desirable to find an insulation system that would allow multiple voltage and current signals to be sensed, without high electrical stress or cross-talk.

SUMMARY

In general, in one aspect, the present disclosure relates to a modular switchgear insulating system that comprises an insulating housing from which at least two air terminations extend, a current interrupter located within the insulating housing, and a tank comprising an actuator that is coupled to the current interrupter. The system can further comprise a current sensor disposed proximate to one of the air terminations. Each of the air terminations are configured to receive a conductor which can be coupled to the current interrupter.

In another aspect, the present disclosure relates to a method of manufacturing a modular switchgear insulation system comprising forming an insulating housing, attaching at least two air terminations to the insulating housing, inserting a current interrupter and an insulating tray into the insulating housing, attaching an actuator via a linkage to the current interrupter, attaching an end conductor to each end of the current interrupter, and enclosing the insulating housing with a tank.

In yet another aspect, the present disclosure relates to a switchgear insulation system comprising a current interrupter with a moveable contact, a stationary contact, a shield, a cylindrical insulator surrounding the shield, and a secondary insulating layer surrounding the cylindrical insulator, the secondary insulating layer having a non-uniform thickness along its length.

In yet another aspect, the present disclosure relates to an insulated switchgear module comprising an enclosure, the enclosure comprising a current interrupter with a secondary surrounding insulator that has a non-uniform shape along its length. The enclosure further comprises an insulating tray have a non-uniform shape corresponding to the non-uniform shape of the current interrupter's secondary insulator. The current interrupter is coupled to an actuator. The insulating tray is located between the current interrupter and the actuator.

In yet another aspect, the present disclosure relates to an insulated switchgear module comprising an enclosure and an insulating tray, the insulating tray defining a cavity. A current interrupter is disposed within the cavity of the insulating tray. On the side of the insulating tray opposite the cavity an actuator is disposed for opening and closing the current interrupter.

These and other embodiments will be described in the following text in connection with the non-limiting examples provided in the figures.

BRIEF DESCRIPTION OF THE FIGURES

The drawings illustrate only example embodiments and are therefore not to be considered limiting in scope, as the example embodiments may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles. In the drawings, reference numerals designate like or corresponding, but not necessarily identical, elements.

DESCRIPTION OF EXAMPLE EMBODIMENTS

Example embodiments disclosed herein are directed to systems and methods for insulating systems for switchgear. Example embodiments are described herein with reference to the attached figures, however, these example embodiments are not limiting and those skilled in the art will appreciate that various modification are within the scope of this disclosure.

Figure 3:
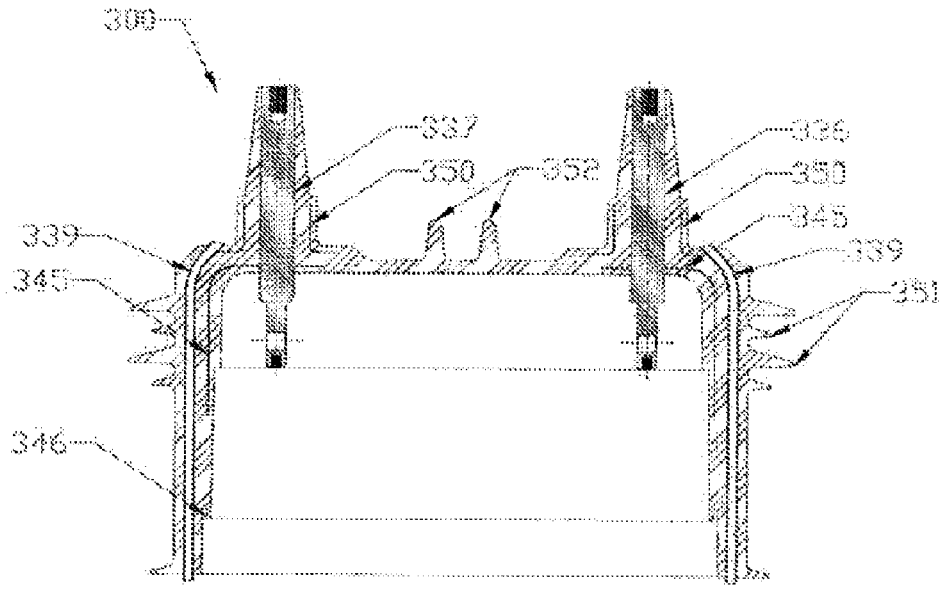
FIG. 3 illustrates a cross-section of an insulating housing in accordance with an example embodiment of the present disclosure.

FIG. 3 presents a cross-section of an insulating housing 300. Insulating housing 300, also called a shell, may be made with any appropriate insulating material, for instance: thermosets, thermoplastics, elastomers, composites, ceramics, or glasses. Insulating housing 300 may be made out of a composite material or polymeric blend or alloy, for instance, fibrous composites, laminated composites, particulate composites, or any combination of some or all of the aforementioned materials. Insulating housing 300 may be made out of a pre-filled two-part cycloaliphatic epoxy. Insulating housing 300 contains two end conductors 336, 337 for carrying current into and out of insulating housing 300. End conductors 336, 337 may either be embedded into insulating housing 300 during fabrication, or be inserted into insulating housing 300 afterwards. End conductors 336, 337 may be made of one or more pieces. End conductors 336, and 337 need not be identical. The profile of insulating housing 300 near conductors 336, 337 may be substantially similar to any bushing profile as described in IEEE 386. Other interface profiles may be used as well. Internal shields 345 may be included in insulating structure 300, and kept at the same potentials as end conductors 336 or 337. Internal shields 350 may also be included in insulating structure 300, but kept at ground potential. Shields 345 and 350 may be made of a conductive material or a semi-conductive material, and may be made of solid or mesh material. Alternately, conductive or semi-conductive surface coatings may also be used. Shields 345 and 350 may be used to grade voltage stresses in insulating housing 300 or the surrounding regions, as described later. Tubes 339 may be included near each of end conductors 336, 337, and may route to elsewhere in insulating structure 300. One or more internal condensation sheds 346 may be used. Likewise, one or more horizontal sheds 351 or vertical sheds 352 may be included for various reasons including electrical creep or strike, mechanical strengthening, heat dissipation, or aesthetics. Various mounting provisions (not shown) including ledges, grooves, fasteners, sheds, and protrusions may also be included, as described later.

Figure 4:
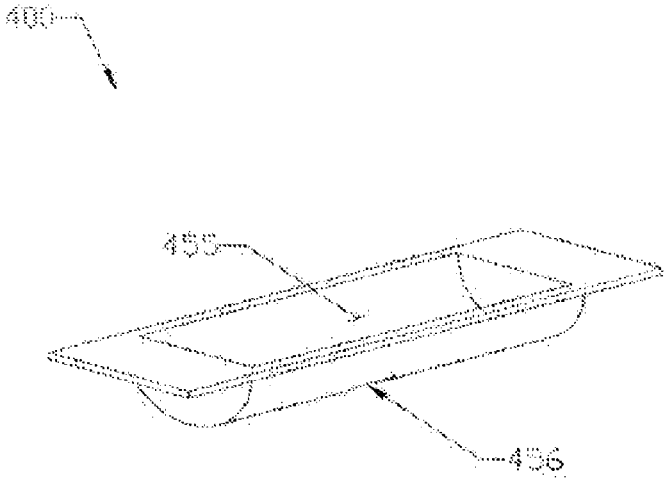
FIG. 4 illustrates an insulating tray in accordance with an example embodiment of the present disclosure.

FIG. 4 illustrates an insulating tray 400 designed to interface with insulating housing 300. Insulating tray 400 may include a concavity 455 and an opening 456, explained with respect to FIG. 5. Insulating tray 400 may be made with any appropriate insulating material, for instance: thermosets, thermoplastics, elastomers, composites, ceramics, or glasses. Insulating tray 400 may be made out of a composite material or polymeric blend or alloy, for instance, fibrous composites, laminated composites, particulate composites, or any combination of some or all of the aforementioned materials. Insulating tray 400 may be made out of a pre-filled two-part cycloaliphatic epoxy.

Figure 5:
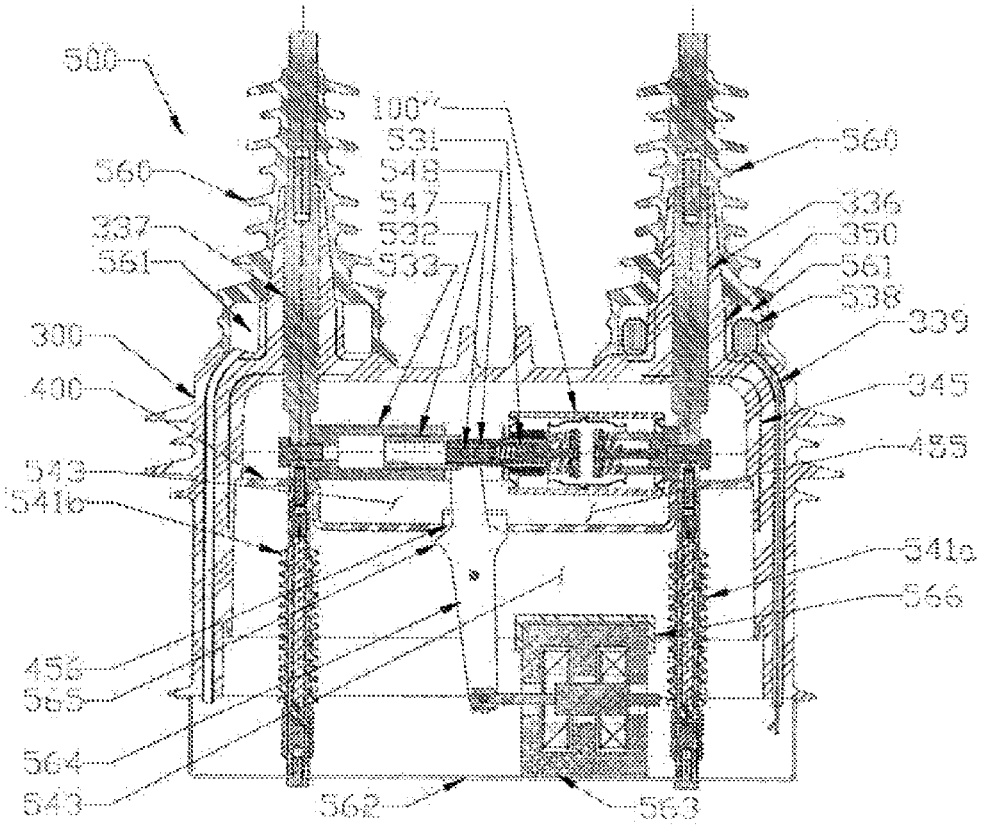
FIG. 5 illustrates a cross-section of an insulated switchgear module in accordance with an example embodiment of the present disclosure.

FIG. 5 shows a cross-section of an insulated switchgear module 500 that uses insulating housing 300 and insulating tray 400. The insulated switchgear module 500 may be used in either single-phase or poly-phase, such as-three phase, switchgear. Modified current interrupter 100" is assembled to end conductor 336. While one type of exemplary vacuum fault interrupter is shown, it is understood that various types of current interrupters may be used, for instance: axial magnetic field vacuum fault interrupters, transverse magnetic field vacuum fault interrupters, radial magnetic field vacuum fault interrupter, load break vacuum switches, or vacuum capacitor switches. Likewise, other interrupting media device may be used as well, for instance sulfur hexafluoride fault interrupters. Regardless of type, the choice of current interrupter may be made after insulating housing has been fabricated. Modified interrupter 100" may include a contact pressure spring 531 held in place with spring coupler 548 and pin 547. Alternately, the contact pressure spring may be located elsewhere in the mechanical system. Interrupter 100" is connected to end conductor 337 via a sliding current exchange piston 532 and current exchange housing 533. Current exchange piston 532 and current exchange housing 533 also provide a bearing to keep the contacts of interrupter 100" properly aligned. Alternately, other current exchanges, as known in the art, may be used, for instance: other sliding or rolling current exchanges, flexible braids, and straps. Likewise, other types of bearing or bushing surfaces may be used to support and align the contacts.

Insulating tray 400 is assembled below interrupter 100", with interrupter 100"partially located in concavity 455. Insulating tray 400, along with insulating housing 300, substantially surround interrupter 100" and isolate its voltages from those below without necessarily coming in direct contact with it. Insulating tray 400 may be aligned in a ledge on the inside surface of insulating housing 300, and may additionally be located via end conductors 336, 337 or other attachment or alignment means, for instance, a groove or a slot. Voltage sensors 541*a*, 541*b* may directly or indirectly be used to hold insulating tray 400 in place. Insulating tray 400 may also include various mounting provisions for other components in system 500, as described below, and may be used to align or reinforce and strengthen components in system 500, including insulating housing 300 and interrupter 100".

Voltage sensors 541*a*, 541*b* may be electrically connected to end conductors 336, 337. Voltage sensors 541*a*, 541*b* are spaced far from each other, and minimize cross-talk with each other. Voltage sensors 541*a*, 541*b* may be routed with their axis generally perpendicular to that of interrupter 100", thereby reducing stress along a surface parallel to that of the axis of interrupter 100". Other angles for voltage sensors 541*a*, 541*b* may be used as well. Additionally, voltage sensors 541*a*, 541*b* need not share a common plane with each other and interrupter 100". While two sensors are shown, either sensor could also be used on its own. Applications where one or more additional voltage sensors could be used, for instance to measure the center shield potential of the interrupter, can be envisioned as well. Additionally, while shown as substantially similar to operating rod 241, it is envisioned that voltage sensors 541*a*, 541*b* could also be different, for instance rubber encapsulated resistors. Voltage sensors 541*a*, 541*b* may alternately be comprised of capacitors, inductors, optics, transducers, active switching components, or any combination thereof. The output leads of voltage sensors 541*a*, 541*b*, may be connected to additional resistors, capacitors, inductors, or other components (not shown) for measurement of voltage.

Insulation system 500 may also include one or more current sensor 538 around either conductor 336 or 337. Current sensor 538 may be chosen based on customer requirements, such as: output signal strength, saturation current and magnetizing current levels, and thus be any kind of current sensor, for instance: a solid or slotted-core current transformer, a Rogowski coil, a Hall-effect sensor, or a flux gate device. The output leads from current sensor 538 may be directed through tubes 339, and connected to other electrical components (not shown) for the measurement of current. One or more current sensors 538 and tubes 339 may be electrically grounded, in which case shields 345, 350 may be used to grade voltages and stresses inside insulation system 500.

Figure 6:
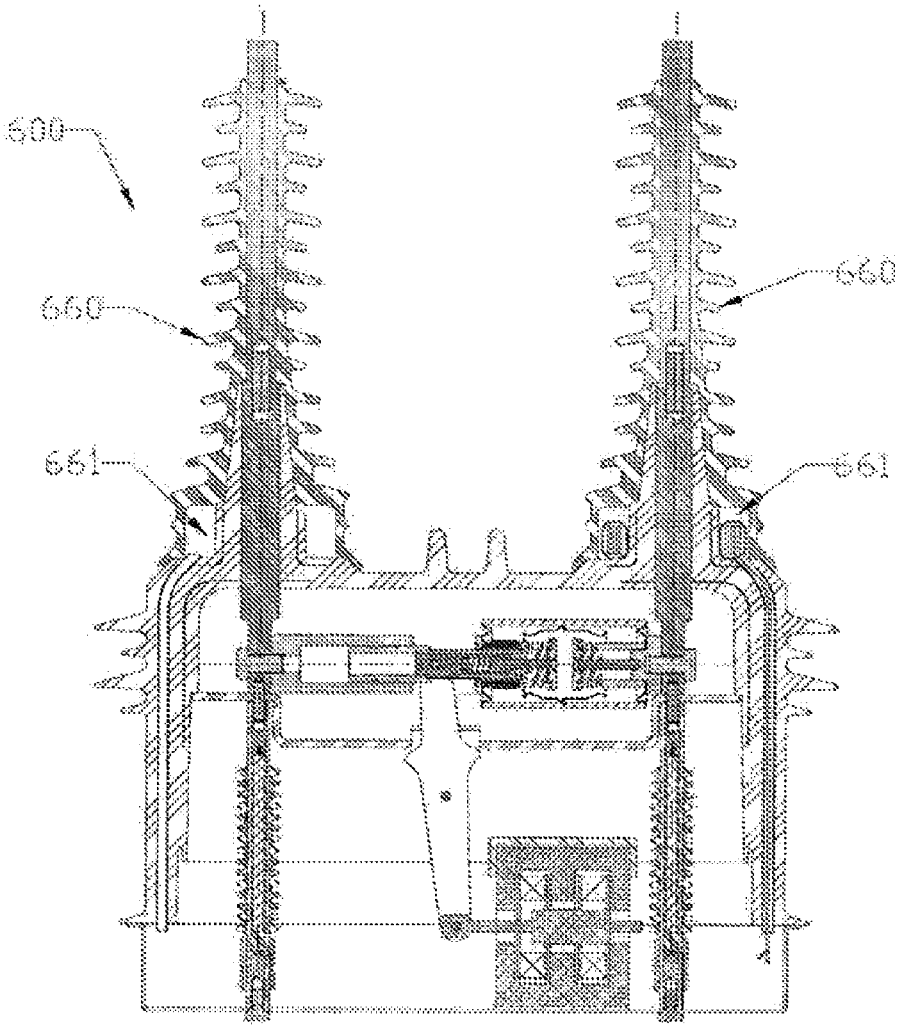
FIG. 6 illustrates a cross-section of an insulated switchgear module in accordance with an example embodiment of the present disclosure.

Insulation system 500 may also include air terminations, sometimes also called air bushings, 560. Air terminations 560 may be chosen based on electrical requirements and allow for customization based on these needs after insulating housing 300 has already been manufactured. For instance, while FIG. 5 shows insulation system 500 with appropriate air terminations for 15.5 kV class switchgear. FIG. 6 shows a cross-section of the same but with air terminations 660 appropriate for 38 kV class switchgear. Air terminations 560 and 660 may be designed with a cavity 561, 661 to surround and protect current sensor 538. Alternatively, in other example embodiments, one or more current sensors 538 can be molded into the insulating housing 300 or the air terminations 560, 660. The conductors and insulation comprising air terminations 560, 660 may be made of one or more pieces.

Returning to FIG. 5, tank 562 may be assembled onto the bottom of insulating housing 300. Tank 562 may be made of an organic material such as an elastomer, thermoplastic, or a thermoset polymeric material including various composites, blends, and alloys. Tank 562 may be made out of any inorganic non-metallic materials such as ceramics and glasses, or metallic materials and alloys, such as steel or aluminum. Tank 562 may be made out of any combination of these materials. Tank 562 protects the interior of insulation housing 300 and other internal components. Tank 562 may also be used to mount internal components, for instance: voltage sensors 541*a*, 541*b* and actuator 563.

Actuator 563 is connected via one or more linkage 564 to open and close interrupter 100". Actuator 563 may be a bi-stable magnetic actuator, a solenoid, a motor, a charged spring, a manual handle, or any other means of providing force and motion to open and close interrupter 100". While actuator 563 is shown so that it actuates in the horizontal direction, other orientations can be anticipated, for instance: vertical, angled, or torsional. One or more linkage 564 may pass through opening 456 in insulating tray 400. While one type of linkage 564 is shown, others may be used as well, for instance, linkage 564 may be one or more linkage or lever including bell cranks, or teeter-totters. One or more linkage 564 may allow some slop in motion so that actuator 563 and spring coupler 548 may move axially while one or more linkages 564 may move rotationally, for instance: oversized holes, slots, or forks. One or more linkage 564 may have one or more extended region 565 used to substantially cover opening 456 in insulating tray 400 to prevent discharges from the high voltage members above insulating tray 400 to the grounded members below insulating tray 400. Alternately, a separate piece of insulating material may be used to substantially cover opening 456 in insulating tray 400 while allowing motion of one or more linkage 564, may be placed above or below opening 456, and may slide along a surface of insulating tray 400. As with insulating housing 300, insulating tray 300, and tank 562, linkages 564 may be made out of any applicable material, materials or combinations of materials. As well as extended region 565, additional ribs, skirts, or sheds may be included in the design of one or more linkage 564 for electrical, environmental, mechanical, or thermal reasons. Actuator 563 and one or more linkage 564 may be mounted either directly or indirectly to any of tank 562, insulating housing 300, or insulating tray 400. Actuator 563 may also include insulating cover 566 to prevent discharges to a conductive surface on actuator 563. Actuator 563 may also function as an electric potential shield, serving to reducing cross talk between voltage sensors 541*a* and 541*b*. A subassembly comprising one or more of interrupter 100", insulating tray 400, voltage sensors 541*a*, 541*b*, tank 562, actuator 563, and one or more linkages 564 may be snapped into place in insulating housing 300. Furthermore, an advantage of the example embodiments described herein is that any one or more of the foregoing subassembly components, as well as the air terminations 560 and the current sensors 538, may be removed and/or replaced if needed to modify the design of the system or for the maintenance of the system.

The interior region 543 of insulating housing 300 in insulation system 500 may be vented to the atmosphere. Alternately, insulating housing 300 and tank 562 may form a sealed envelope, and interior region 543 may be filled with any insulating fluid, for instance: air, nitrogen, sulfur hexafluoride (SF6), or mineral oil. The fluid in region 543 may be kept at any pressure, including: at, above, or below atmospheric pressure. Alternately, some of interior region 543 could be filled with other applicable materials as well, for instance, the region around interrupter 100" could be filled with a fluid compound which is then cured to form an elastomer or thermoset material.

Figure 7:
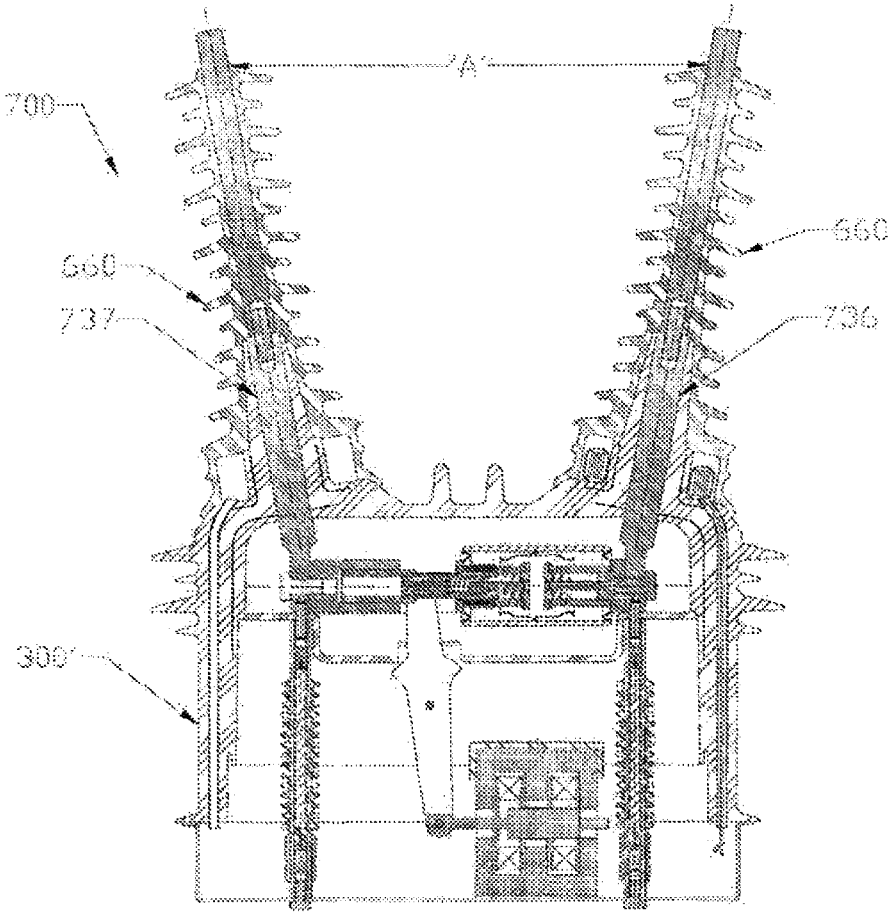
FIG. 7 illustrates a cross-section of an insulated switchgear module in accordance with an example embodiment of the present disclosure.

FIG. 7 shows a cross-section of modular insulation system 700 utilizing an alternate insulating housing 300'. Alternate insulating housing 300' has angled conductors 736, 737, which allow distance 'A' to increase with longer air termination sizes associated with higher voltage class terminations 660, thus increasing the appropriate air insulation level for higher voltages. This allows housing 300' to be made smaller than would otherwise be necessary for higher voltage modularity.

Figure 8:
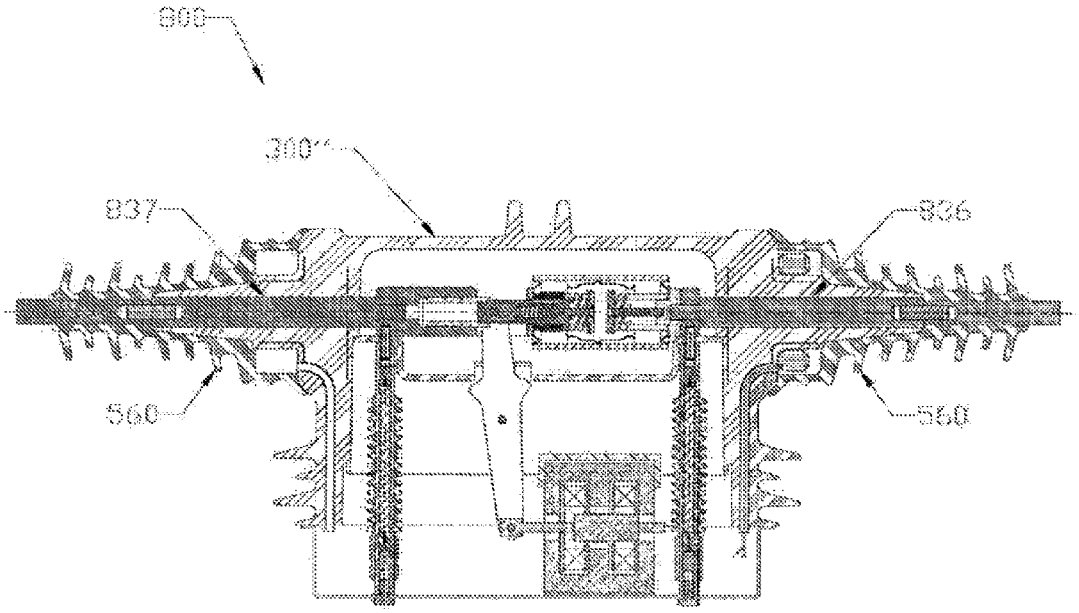
FIG. 8 illustrates a cross-section of an insulated switchgear module in accordance with an example embodiment of the present disclosure.

FIG. 8 shows a cross-section of modular insulation system 800 utilizing an alternate insulation housing 300". Alternate insulating housing 300" has horizontal conductors 836, 837 which maximize the electrical isolation between them. Insulation system 800 maintains a low profile, reducing the vertical clearance that may be necessary when compared with insulation systems 500, 600, and 700.

While FIGS. 5 through 8 show systems in which air terminations are both vertical, both horizontal, or both angled, other orientations can be envisioned, for example: one may be vertical while the other is horizontal, one may be vertical while the other is angled, or one may be angled while the other is horizontal. Any angle may be used for the air terminations. Other size air terminations than those shown may be used as well, for instance appropriate for 27 kV class switchgear. Likewise, while air terminations are shown as connected to end conductors 336, 337, it can also be envisioned that grounded surface separable insulated disconnects, elbows, cables, or other connections consistent with IEEE 386 or other applicable standards, as well as non-standardized connections may be connected to conductors 336, 337 as well.

Figure 9:
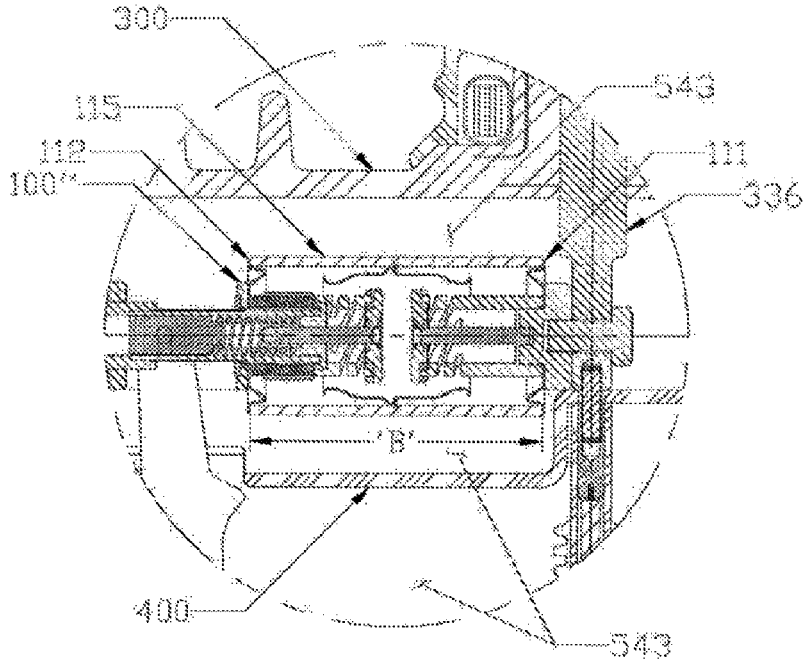
FIG. 9 illustrates a close-up view of an interrupter in accordance with an example embodiment of the present disclosure.

FIG. 9 shows a close-up view near interrupter 100" of insulation system 500. While FIGS. 9 through 18 are discussed in relation to insulation system 500, it is understood that this discussion applies equally to other insulation systems as well, for instance: 600, 700, 800, or any other variation as described above. Distance 'B' represents a minimum distance between two different exposed voltages, shown in FIG. 9 as the moving and stationary endcaps 111, 112. Depending on the fluid filling space 543 inside housing 300, distance 'B' may be inadequate to withstand the voltages that insulation system 500 may be exposed to without discharges occurring.

Figure 10:
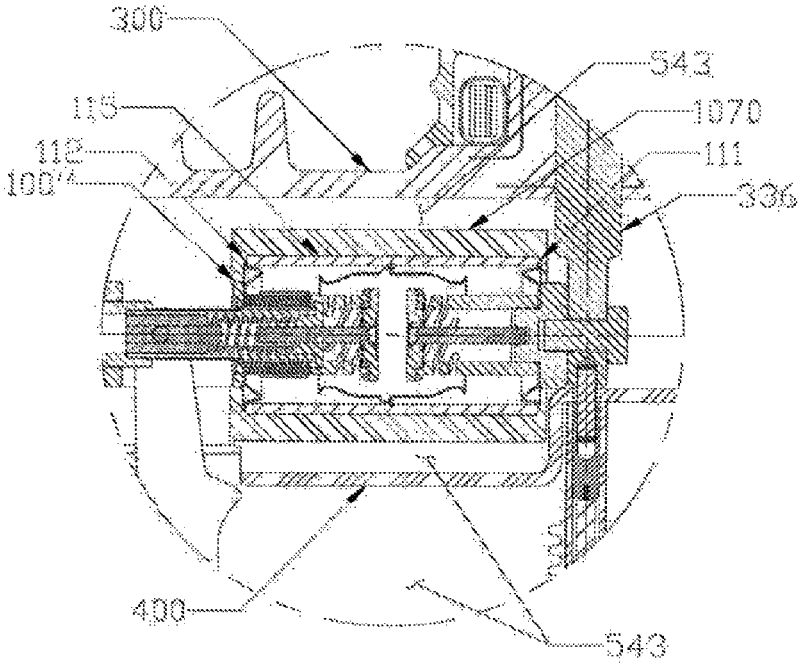
FIG. 10 illustrates a close-up view of an interrupter in accordance with an example embodiment of the present disclosure.

FIG. 10 shows an insulating layer 1070 that has been applied to the exterior of interrupter 100" as known in the art (Slade, Paul G., *The Vacuum Interrupter: Theory, Design, and Application*, CRC Press, New York, 2008, p. 28). Insulation layer 1070 wraps around the entire circumference of insulator 115 as well as some of endcaps 111, 112. Insulation layer 1070 may be any applicable insulating material, for instance: polyurethane, silicone rubber (SiR), ethylene propylene diene monomer (EPDM), or epoxy. Insulating layer 1070 may be cast or molded or otherwise formed in place, or applied after being formed, and may be stretched, expanded, or swollen when applied. Adhesives or bonding agents may be used. Insulating layer 1070 covers the highly-stressed exposed voltages at either end of interrupter 100", preventing discharges from occurring.

Figure 11:
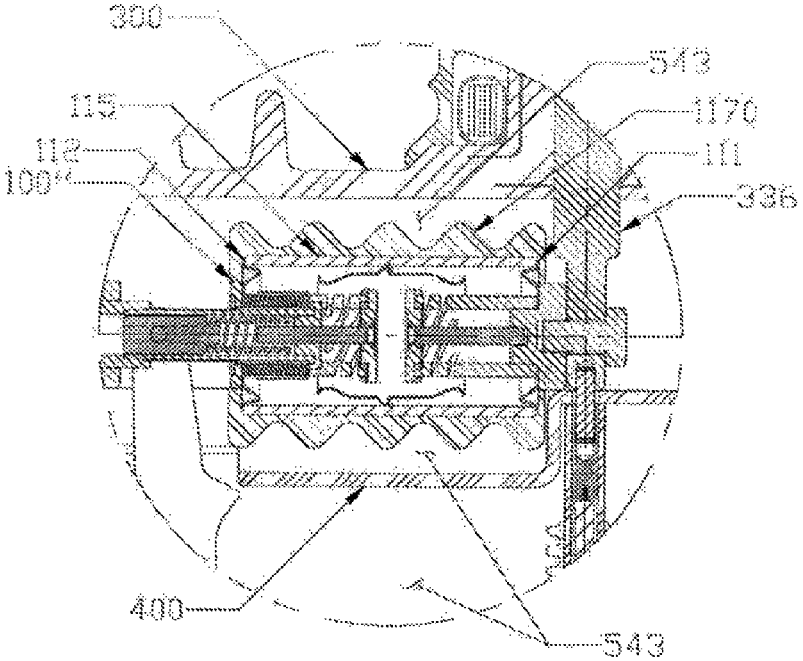
FIG. 11 illustrates a close-up view of an interrupter in accordance with an example embodiment of the present disclosure.

FIG. 11 shows an alternate insulating layer 1170 with a waved surface to increase a surface length along insulating layer 1170, to reduce tracking and condensation along an external surface of insulating layer 1170. Alternately, insulator 115 may have a waved exterior surface.

Figure 12:
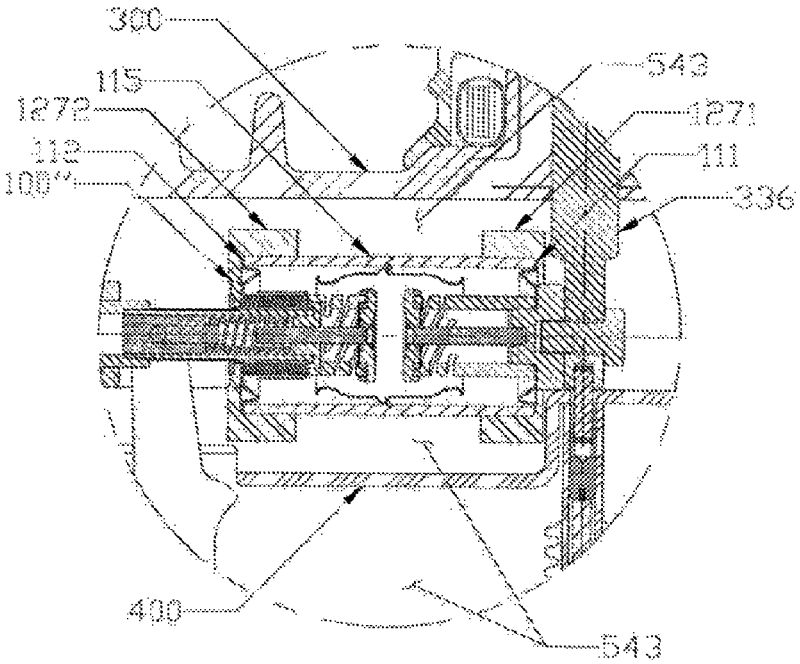
FIG. 12 illustrates a close-up view of an interrupter in accordance with an example embodiment of the present disclosure.

It may not be necessary to cover the full insulator 115 of interrupter 100". FIG. 12 shows alternate insulation layers 1271, 1272 which only cover those portions of the surface of interrupter 100" in the vicinity of metallic endcaps 111, 112, respectively thereby preventing discharges from their highly stressed metallic surfaces. As with insulating layer 1070, insulating layers 1271, 1272 may be made out of any applicable insulating material. Likewise. 1271, 1272 may be cast or molded or otherwise formed in place, or applied after being formed. If applied after being formed, they may be stretched, expanded, or swollen when applied. Adhesives or bonding agents may be used.

Figure 1:
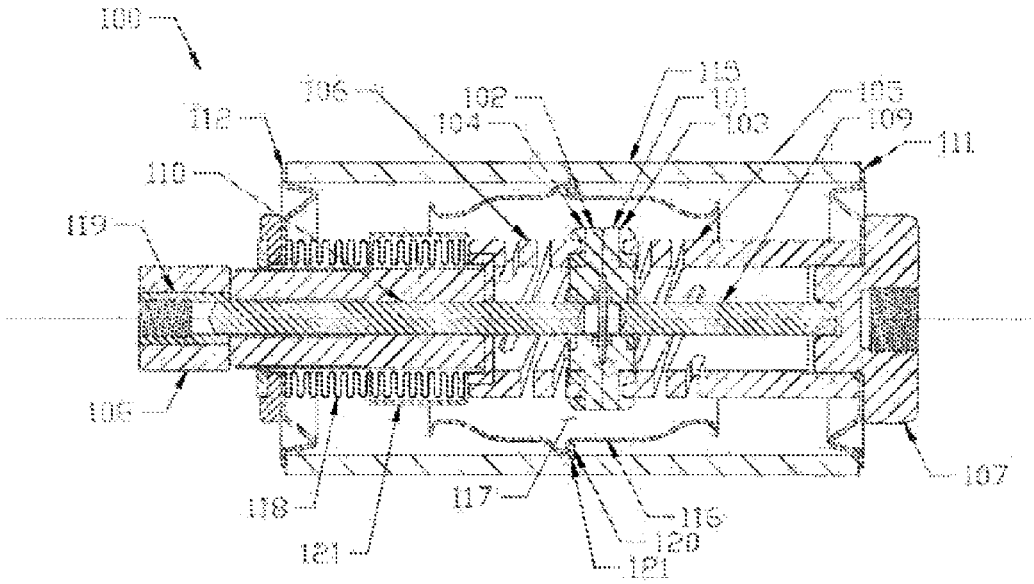
Figure 1 (prior art)
FIG. 1 illustrates an example vacuum fault interrupter as known in the prior art.
Figure 2:
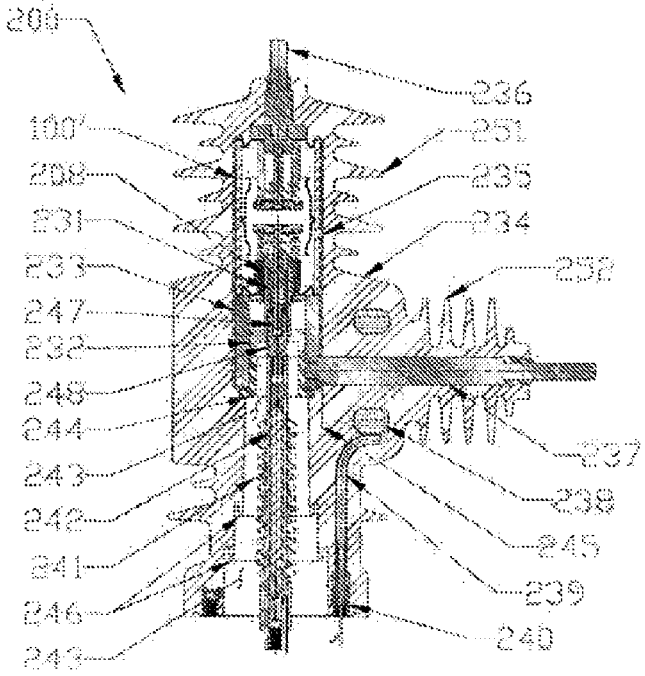
Figure 2 (prior art)
FIG. 2 illustrates an example insulation system for a vacuum fault interrupter as known in the prior art.
Figure 13:
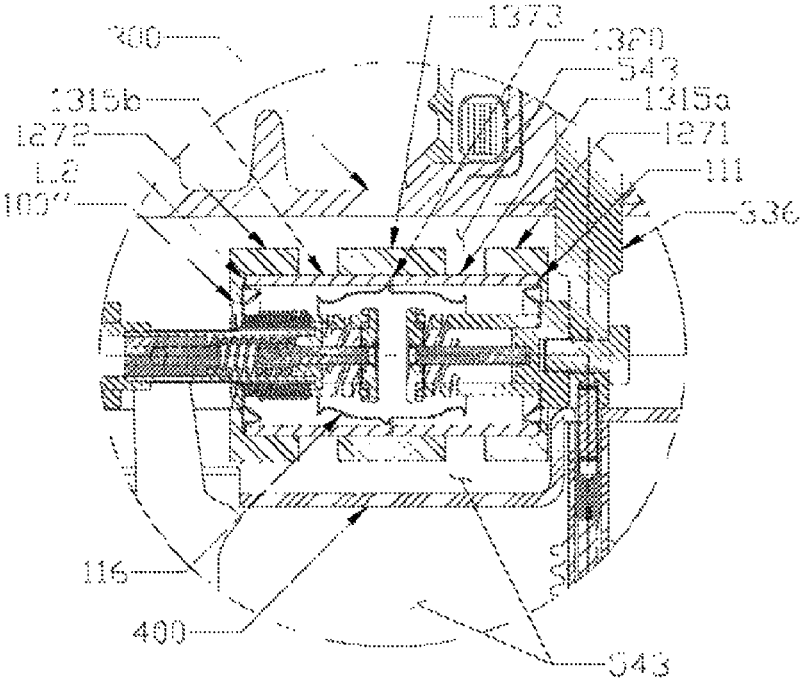
FIG. 13 illustrates a close-up view of an interrupter in accordance with an example embodiment of the present disclosure.

While interrupter design 100 and 100' use a center shield 116 which is mounted via ring 120 in groove 121 in insulator 115 (FIG. 1), this need not always be the case. FIG. 13 shows alternate interrupter 100'", using two insulators 1315*a*, 1315*b*, each of which is approximately half the length of insulator 115. Insulators 1315*a* and 1315*b* are held together via ring 1320, which may be used to mount center shield 116. Ring 1320 may be exposed to the exterior of interrupter 100'". In this case, it may be desirable to cover the exterior surface of interrupter 100'" in the vicinity of ring 1320 via insulating layer 1373. Insulating layer 1373 may reduce discharges in the vicinity of ring 1320. As with insulating layers 1070, 1271, and 1272, insulating layer 1373 may be made out of any applicable insulating material. Likewise, it may be cast or molded or otherwise formed in place, or applied after being formed, and may be stretched, expanded, or swollen when applied. Adhesives or bonding agents may be used. It may be desirable to use insulating layer 1373 even if insulator 115 is used instead of insulators 1315*a*, 1315*b* and there is no exposed ring 1320, and center shield 116 is mounted as in FIG. 1. Likewise, insulating layer 1070 or 1170 may be used to protect an exposed center ring 1320.

Figure 14:
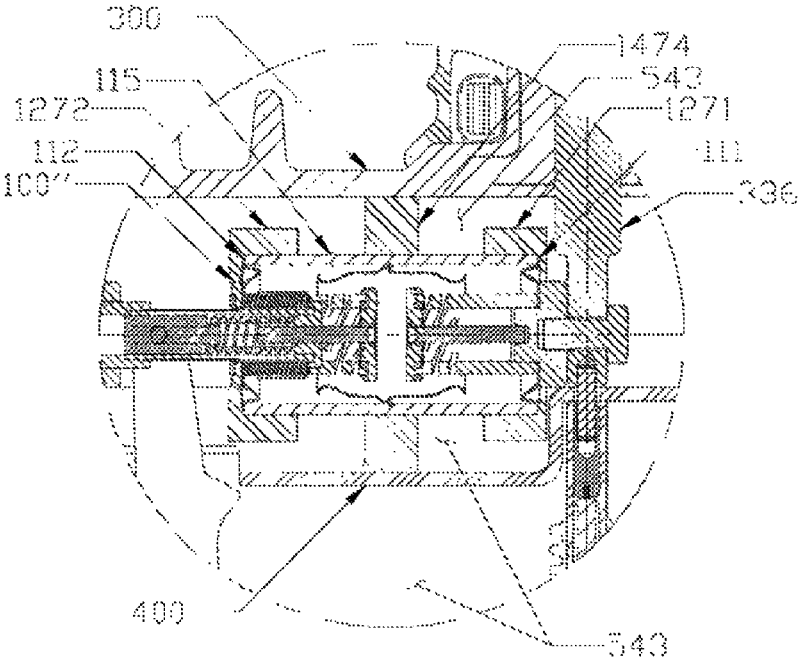
FIG. 14 illustrates a close-up view of an interrupter in accordance with an example embodiment of the present disclosure.

It may be desirable to isolate the voltages at either end of interrupter 100"completely by putting one or more isolating barrier 1474 along the outer surface of interrupter 100" as shown in FIG. 14. Isolating barrier 1474 prevents electrical discharges from passing from one end of interrupter 100' to the other end. Isolating barrier 1474 also serves to isolate end conductor 336 from end conductor 337 (not shown in FIG. 14), or any other exposed voltage. Isolating barrier may be made out of any applicable insulating material. It may be cast or molded or otherwise formed in place, or applied after being formed, and may be stretched, expanded, compressed, or swollen when applied. Adhesives or bonding agents may be used on either the inside or outside diameters. Isolating barrier 1474 may be placed anywhere along the external surface of interrupter 100", for instance: near the middle of insulator 115 or near the ends of insulator 115, where either of insulating layers 1271, 1272 are placed.

Figure 15:
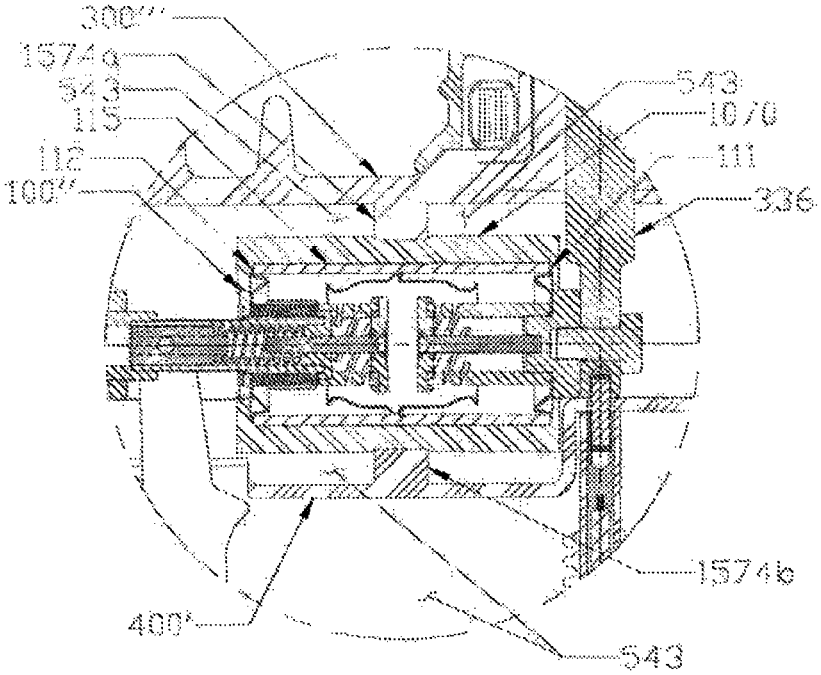
FIG. 15 illustrates a close-up view of an interrupter in accordance with an example embodiment of the present disclosure.

Isolating barrier 1474 may be comprised of one or more materials. Some or all of isolating barrier 1474 may be part of housing 300, tray 400, or insulator 115. For instance, FIG. 15 shows housing 300'" and tray 400' which each include protrusions 1574*a*, 1574*b* respectively, which push into and deform insulating layer 1070, making a tight dielectric seal. Additionally, protrusions 1574*a* and 1574*b* may interlock (not shown) where housing 300'" meets tray 400', so as also to provide a dielectric seal and reduce discharges from one end of interrupter 100" to the other, or reduce discharges between any other two different voltages in system 500.

Figure 16:
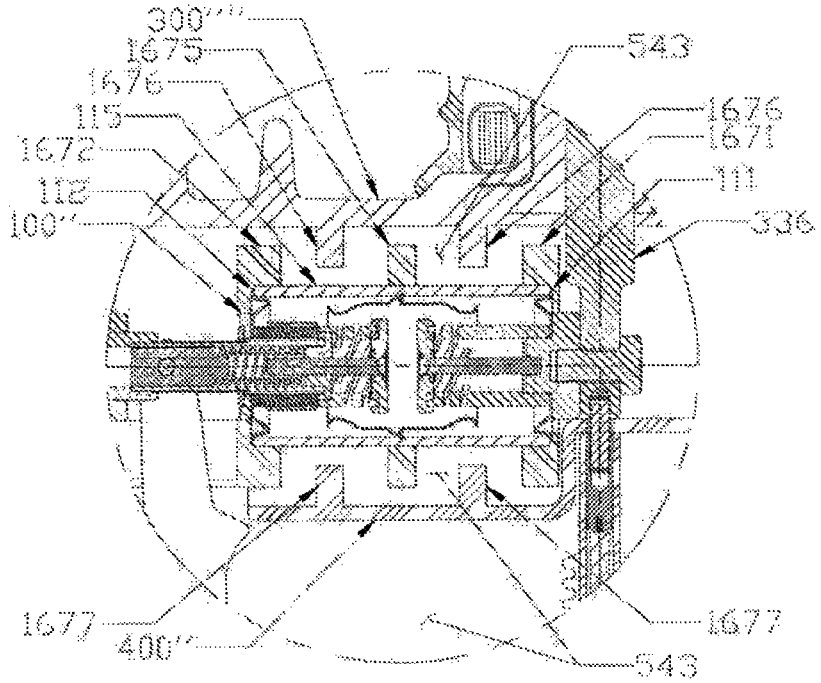
FIG. 16 illustrates a close-up view of an interrupter in accordance with an example embodiment of the present disclosure.
Figure 17:
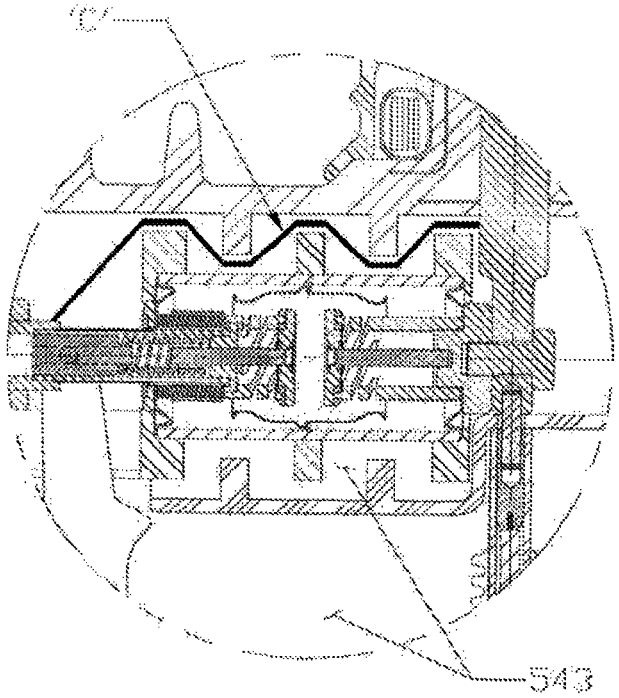
FIG. 17 illustrates a close-up view of an interrupter in accordance with an example embodiment of the present disclosure.

FIG. 16 shows another method of reducing discharges. One or more insulating end rings 1671, 1672 may envelop the ends of interrupter 100". One or more insulating rings 1675 may wrap around other locations on the exterior of interrupter 100". Insulating rings 1671, 1672, 1675 may be cast or molded or otherwise formed in place, or applied after being formed, and may be stretched, expanded, or swollen when applied. Adhesives or bonding agents may be used. One or more of insulating rings 1671, 1672, 1675 may be part of insulator 115. One or more insulating protrusions 1676 may be created on the inside surface of modified housing 300"". Likewise, one or more insulating protrusions 1677 may be created on the inside surface of modified tray 400". One or more insulating protrusions 1676 may be part of modified housing 300"", or may be a separately manufactured piece attached to housing 300. One or more insulating protrusions 1677 may be part of modified tray 400', or may be a separately manufactured piece attached to tray 400. If manufactured separately from housing 300 and tray 400, protrusions 1676, 1677 may be cast or molded or otherwise formed in place, or applied after being formed, and may be stretched, expanded, compressed, or swollen when applied. Adhesives or bonding agents may be used. Protrusions 1676, 1677 may interlock to form one or more single rings encircling interrupter 100'. If manufactured separately from housing 300 and tray 400, each of protrusions 1676, 1677 may be separate halves of one ring. Rings 1671, 1672, 1675, and protrusions 1676, 1677 may be interconnected and made of one or more parts, for instance, multiple protrusions 1675 could form waved insulating sleeve 1170. Using one or more protrusions 1676, 1677 along with one or more of insulating rings 1671, 1672, 1675 forms a extended path 'C,' shown in FIG. 17, that a discharge must take to bridge from one voltage to the other across interrupter 100" through the fluid filling space 543. Extended path 'C' is greater than distance 'B' of FIG. 9, and reduces discharges in insulating system 500.

Figure 18:
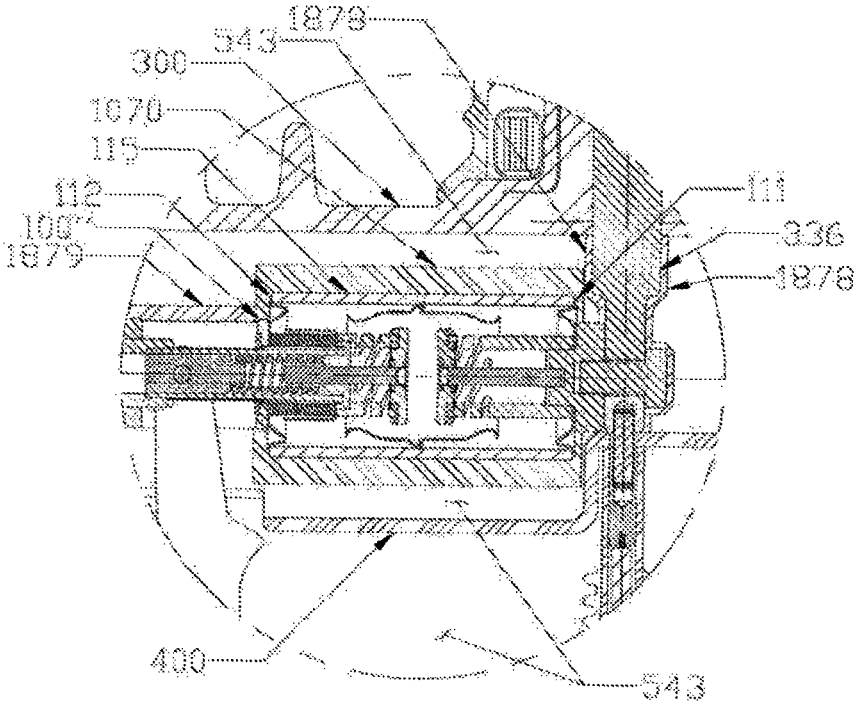
FIG. 18 illustrates a close-up view of an interrupter in accordance with an example embodiment of the present disclosure.

It may additionally be necessary to cover other high voltage members. FIG. 18 shows insulating layer 1878, which may be used to cover the exposed voltage of either conductor 336 or 337, and insulating layer 1879, which may be used to cover portions of the current exchange assembly. By covering or otherwise isolating exposed voltages, insulating layers 1878, 1879 decrease discharges in insulating system 500. Insulating layers 1878, 1879 may be any suitable material, for instance, polyurethane, silicone rubber (SiR), ethylene propylene diene monomer (EPDM), or epoxy. Insulating layers 1878, 1879 may be cast or molded or otherwise formed in place, or applied after being formed, and may be stretched, expanded, compressed, or swollen when applied. Adhesives or bonding agents may be used. Insulating layers 1878, 1879 may be comprised of more than one material. Insulating layers 1878, 1879 may be formed from one or more pieces, and one or more of those pieces may be formed as a portion of either housing 300 or tray 400.

Figure 19:
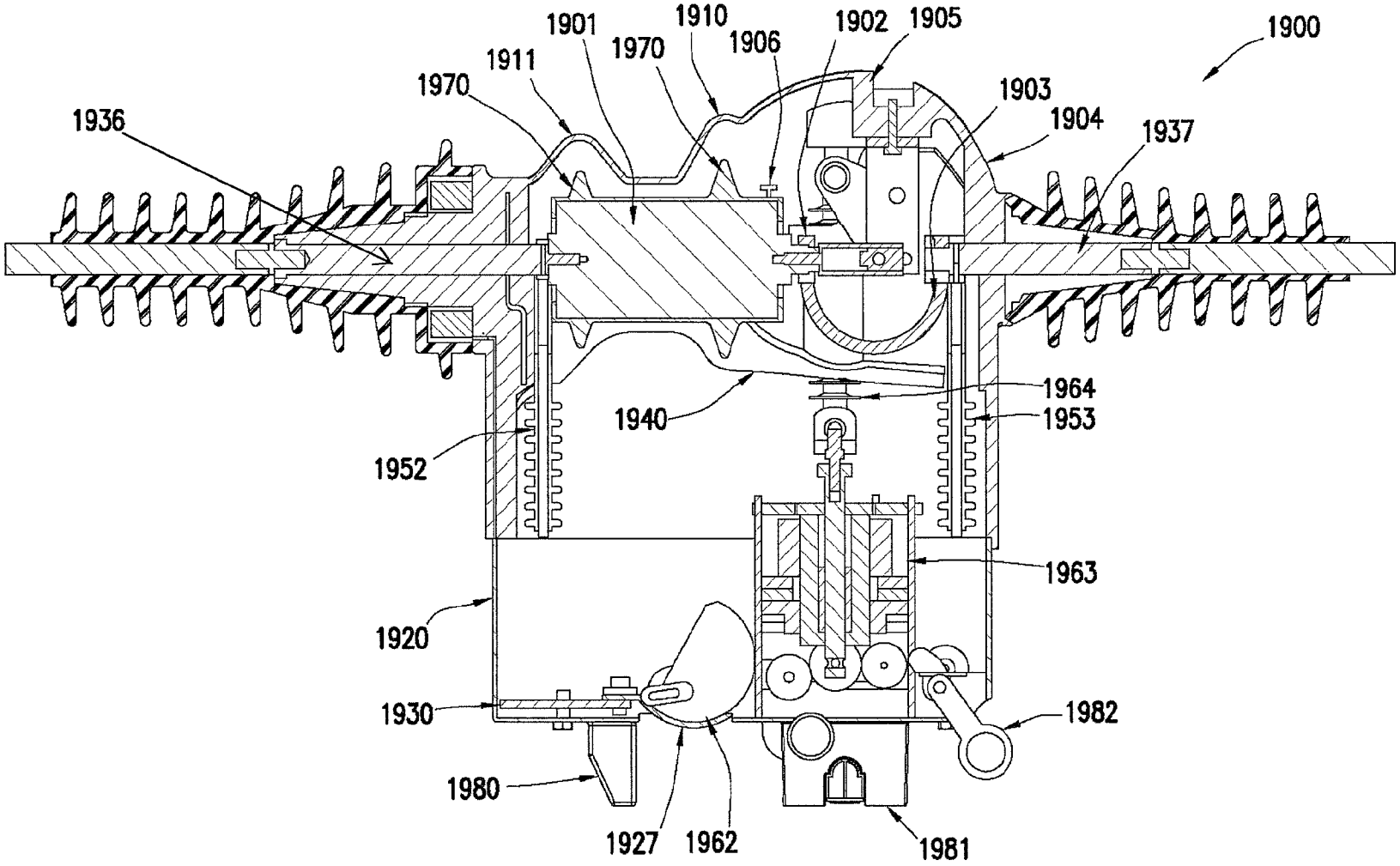
FIG. 19 illustrates a side cross-section of an insulated switchgear module in accordance with an example embodiment of the present disclosure.

Referring to FIG. 19, a side cross-section view of an insulated switchgear module 1900 in accordance with an example embodiment of the present disclosure is illustrated. Insulated switchgear module 1900 contains some of the same characteristics and features as the switchgear modules described in FIGS. 3-18, but also contains certain unique characteristics and features. For the sake of brevity, those features in FIG. 19 that are shown appearing the same as or similar to the features previously described in FIGS. 3-18 will not be described in detail again.

Insulated switchgear module 1900 comprises a vacuum interrupter 1901. The vacuum interrupter 1901 is connected to end conductors 1936 and 1937, each of which are embedded in air terminations similar to those described previously. The vacuum interrupter 1901 can also be supported at the moving end of the interrupter by a support bracket 1906 that wraps around the vacuum interrupter 1901 and fastens to a top portion of housing 1904. The support bracket 1906 helps to relieve the cantilever stress on the stationary end of the vacuum interrupter 1901 that connects to end conductor 1936. The example vacuum interrupter 1901 also comprises a current exchange assembly 1902 with a laminated strap 1903. The laminated strap 1903 can be connected to end pads that are part of the current exchange assembly 1902. Because minimizing the size of the switchgear module is desirable, the size of the current exchange assembly 1902 can be reduced by setting the end pads within recesses (also referred to as counterbores). As described previously, other types of current exchangers can be implemented with the vacuum interrupter.

Figure 25:
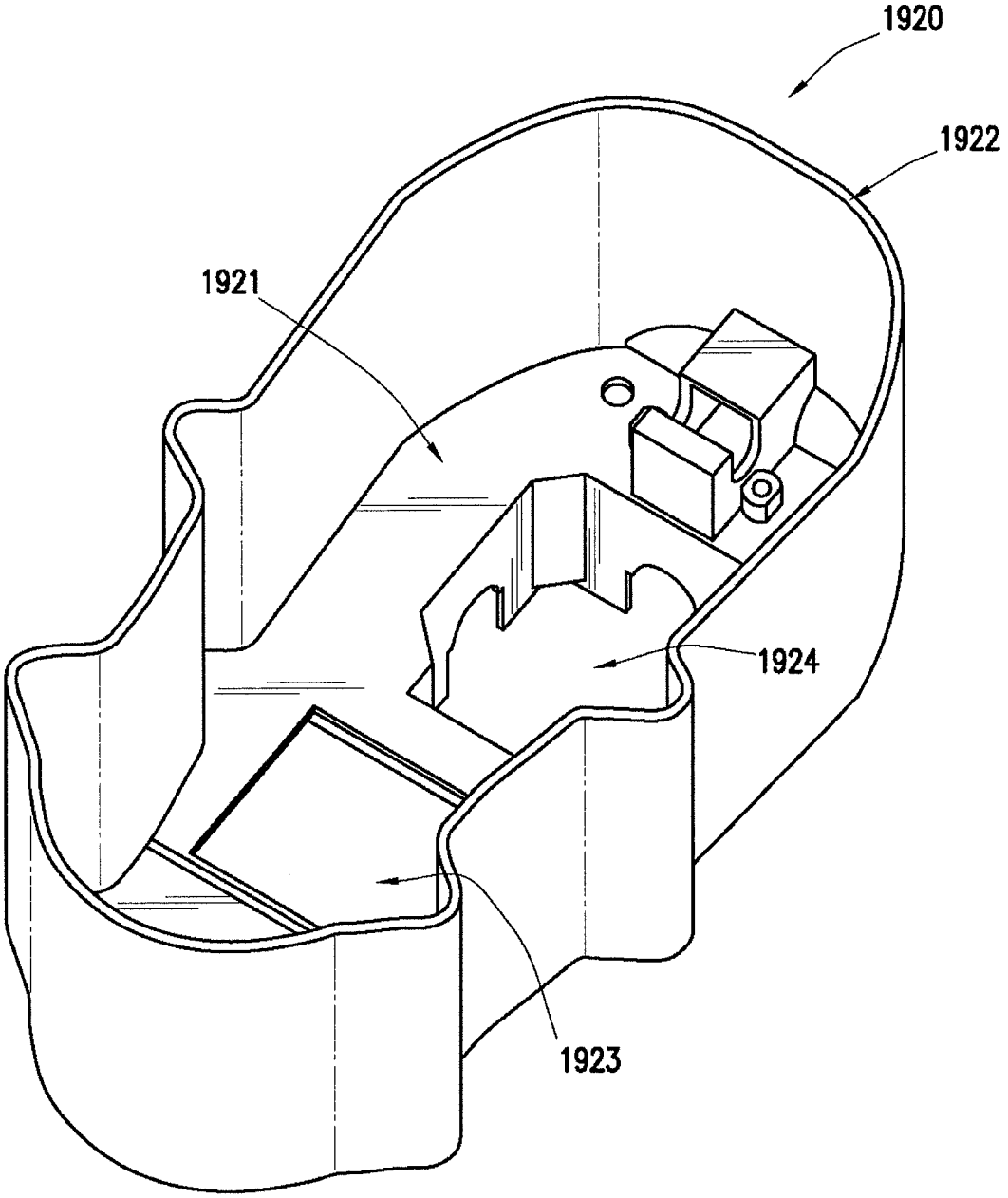
FIG. 25 illustrates a tank in accordance with an example embodiment of the present disclosure.
Figure 27:
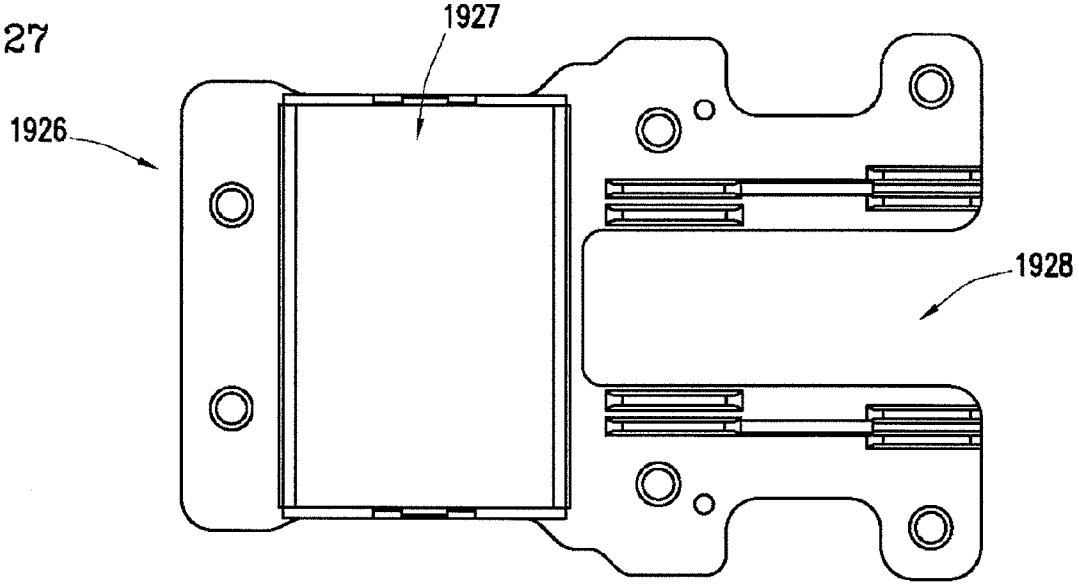
FIG. 27 illustrates a bottom view of an indicator window in accordance with an example embodiment of the present disclosure.
Figure 28:
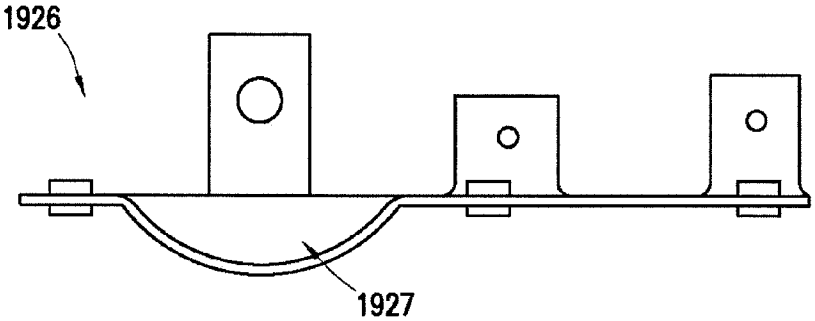
FIG. 28 illustrates a side view of the indicator window in accordance with an example embodiment of the present disclosure.

Example insulated switchgear module 1900 includes a tank 1920 containing various components, including an indicator 1962 and an actuator mechanism 1963. As illustrated in greater detail in FIG. 25, the tank 1920 comprises a tank base 1921 and a tank wall 1922 which together define a cavity within the tank. The tank also includes a cable connector opening 1924 and a window opening 1923. A viewing window 1926, as shown in FIGS. 27 and 28, can be secured to the bottom inside surface of the tank 1920. The viewing window 1926 comprises a curved viewing portion 1927 through which an indicator located inside the tank can be observed from outside the insulated switchgear module 1900. For example, the indicator 1962 may be coupled to the actuator mechanism 1963 and may indicate whether the vacuum interrupter is open or closed. The viewing window 1926 also comprises a cutout 1928 to accommodate the cable connector opening 1924.

Referring again to the view of the tank shown in FIG. 19, a handle 1982 extends outside the tank 1920 and can be used to manually open the vacuum interrupter 1901. Also located outside the tank 1920 is a support member 1980 that supports the insulated switchgear when resting on a surface. A cable connector 1981 is mounted on the bottom surface of the tank 1920 over the cable connector opening 1924 and facilitates connection of a control cable to the actuator and other components located within the tank 1920. The cable connector 1981 has multiple apertures which facilitate connecting the control cable from various directions.

Figure 26:
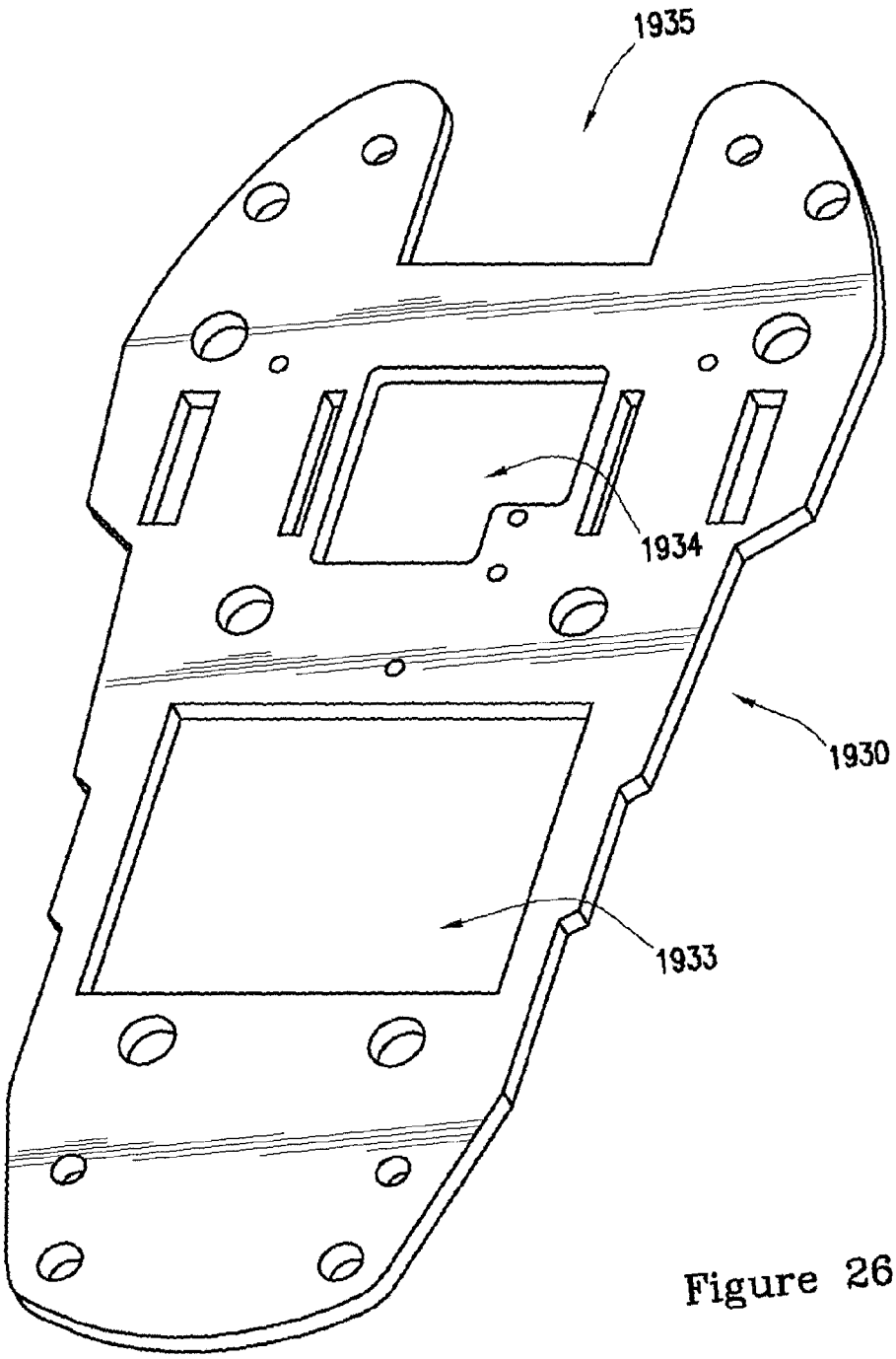
FIG. 26 illustrates an intermediate plate in accordance with an example embodiment of the present disclosure.

Also disposed inside the tank 1920 between the inside surface of the tank base 1921 and the actuator mechanism 1963 is an intermediate plate 1930. The intermediate plate 1930 is shown in greater detail in FIG. 26. As seen in FIG. 26, the intermediate plate 1930 comprises actuator opening 1934 to permit the actuator mechanism 1963 to connect to a control cable that can enter the module through the cable connector 1981. The intermediate plate 1930 also comprises opening 1933 through which extends curved viewing portion 1927 of the viewing window 1926. Cutout 1935 permits the handle 1982 to connect to the actuator mechanism 1963. The intermediate plate 1930 facilitates assembling the components of the insulated modular switchgear 1900 before the tank 1920 is secured to the bottom of the module. Lastly, the intermediate plate 1930 can comprise several smaller apertures, as shown in FIG. 26, which can be used to attach supports or other components of the module.

Referring again to FIG. 19, one or more voltage sensors, such as first voltage sensor 1952 and a second voltage sensor 1953, can be included in the insulated switchgear module 1900. First voltage sensor 1952 and second voltage sensor 1953 are shown attached to insulating tray 1940 as described further below in connection with FIGS. 21A-22. In certain example embodiments, the voltage sensors 1952 and 1953 can interface with the intermediate plate 1930 or with another insulating tray (not shown) disposed between insulating tray 1940 and the tank. As described further below, the insulating tray 1940 has a shape that corresponds with both the shape of the outer surface of the vacuum interrupter 1901 and the shape of the inner surface of the housing 1904. The outer portion of the vacuum interrupter 1901 includes insulating rings 1970. As similarly discussed above in connection with FIGS. 16 and 17, forming the insulating tray 1940 in a shape that corresponds with both the insulating rings 1970 on the outer surface of the vacuum interrupter 1901I and the inner surface of the housing 1904 reduces the likelihood of a discharge and therefore improves the insulating characteristics of the insulating tray 1940.

Figure 20:
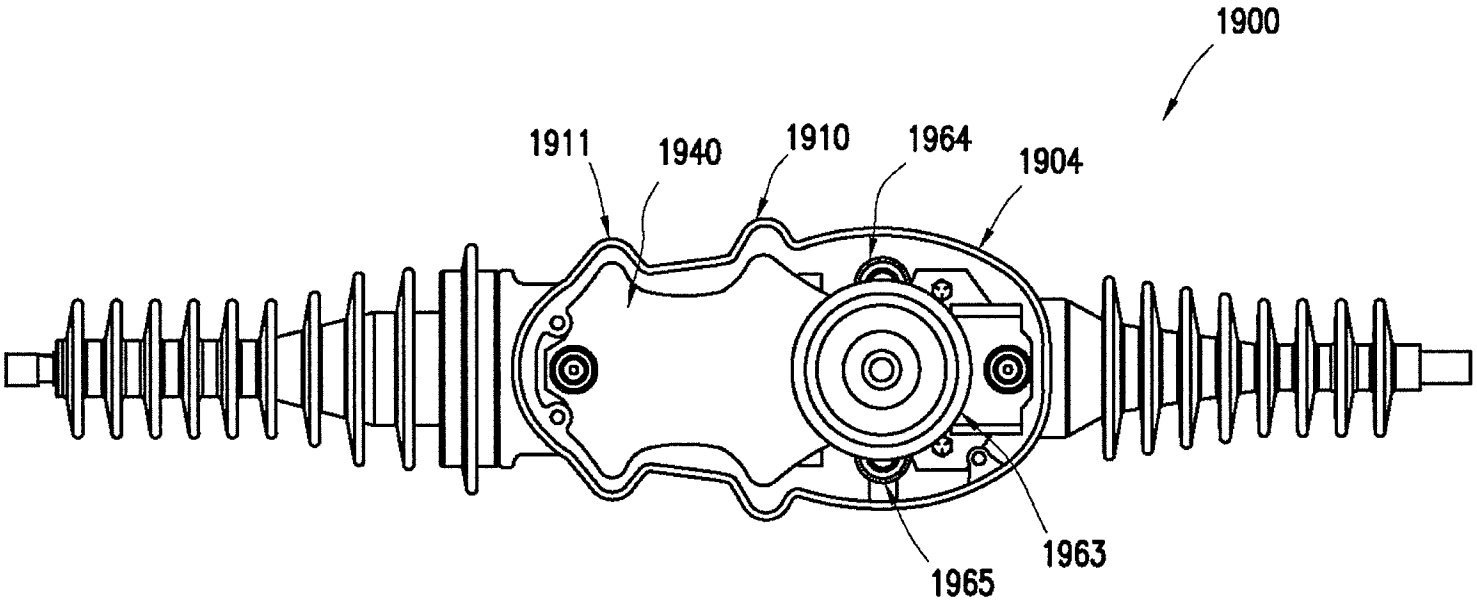
FIG. 20 illustrates a bottom cross-section of the insulated switchgear module of FIG. 19.
Figure 23:
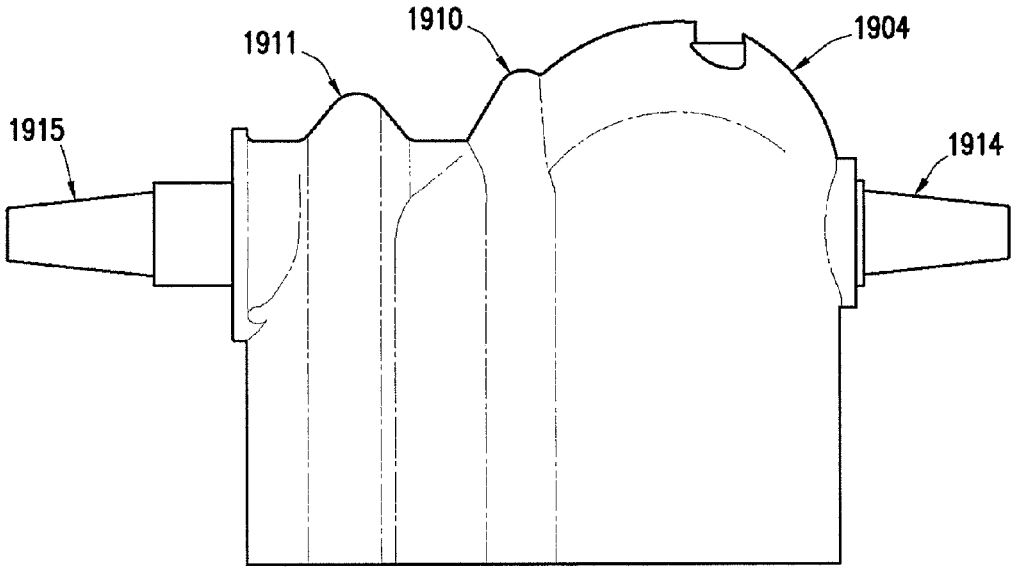
FIG. 23 illustrates a side view of a housing in accordance with an example embodiment of the present disclosure.
Figure 24:
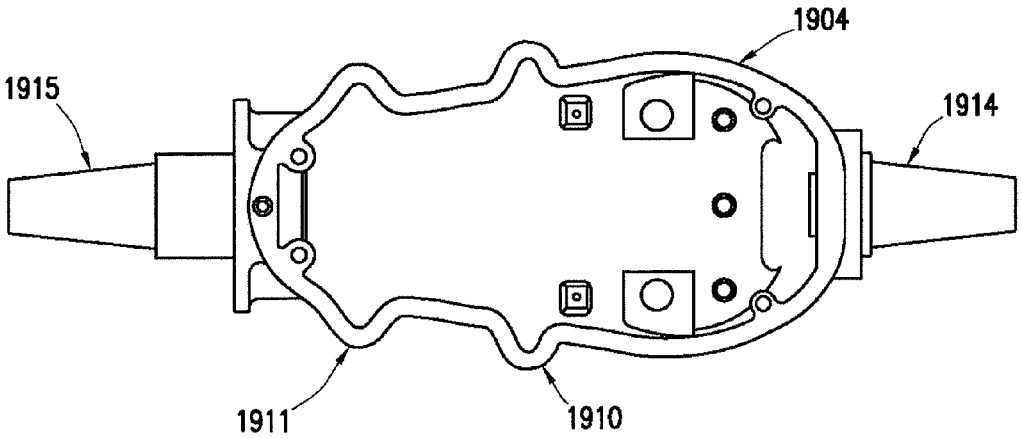
FIG. 24 illustrates a bottom view of a housing in accordance with an example embodiment of the present disclosure.

Referring to FIG. 20, a bottom cross-section view of the example insulated switchgear module 1900 is shown. FIG. 20 shows a cross-section taken through the actuator mechanism 1963 with linkages 1964 and 1965 viewed from the bottom of each linkage. FIG. 20 illustrates that the shape of the inner surface of the housing 1904 can be conformed to correspond with the shape of the insulating tray 1940 and the insulating rings 1970 disposed on the outside of the vacuum interrupter 1901. In particular, housing 1904 comprises protrusions 1910 and 1911 which correspond with protrusions on the insulating tray 1940 and the insulating rings 1970. FIG. 23 shows an outer side view of housing 1904 and FIG. 24 shows a cross-section of housing 1904 without the components disposed within the housing. FIGS. 23 and 24 further illustrate protrusions 1910 and 1911 and the fact that the housing 1904 is shaped to correspond with the shape of the insulating tray 1940 and the insulating rings 1970. It should be appreciated that in alternate embodiments, such as those described above in connection with FIGS. 10-18, the shape of the vacuum interrupter and any insulators placed around the vacuum interrupter can take a variety of configurations. In such alternate embodiments, the shape of the insulating tray 1940 and the housing 1904 can be modified with additional protrusions or contours so that they correspond with the shape of the vacuum interrupter and any insulators on the outside of the vacuum interrupter.

Figure 21A:
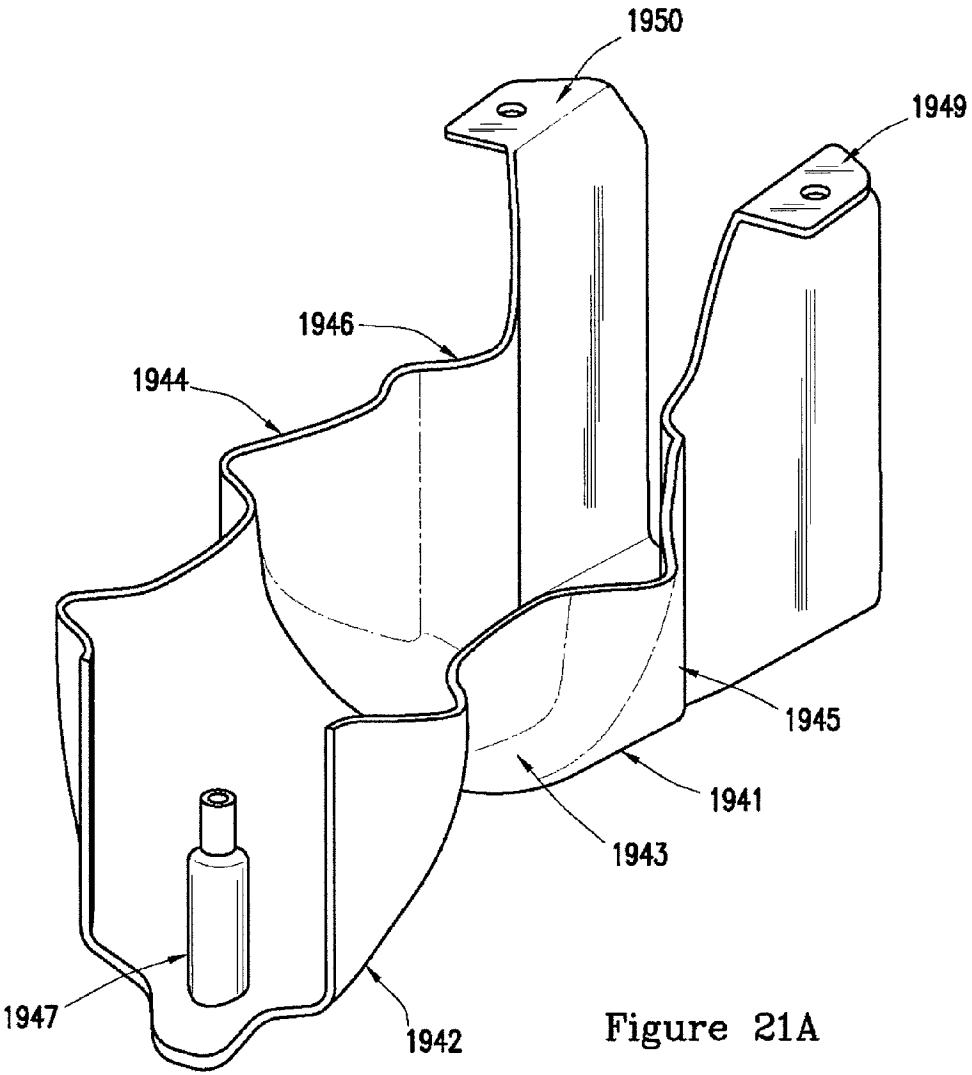
FIGS. 21A, 21B, and 21C illustrate left side perspective, right side perspective and front views of an insulating tray in accordance with an example embodiment of the present disclosure.
Figure 21B:
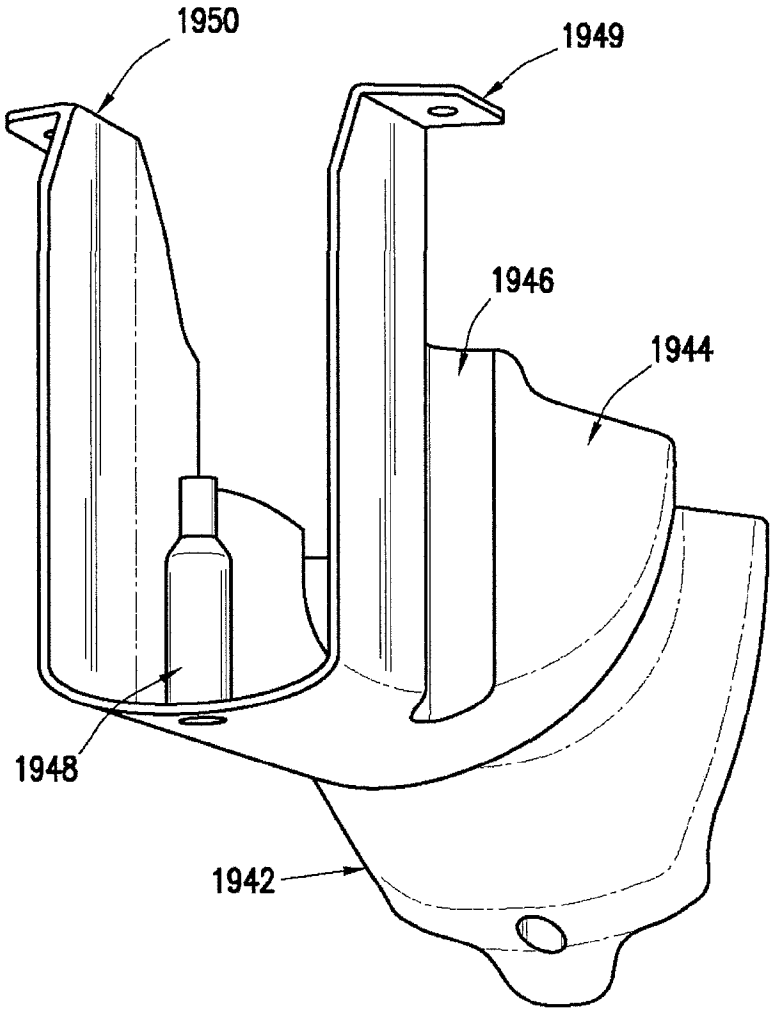
Figure 21C:
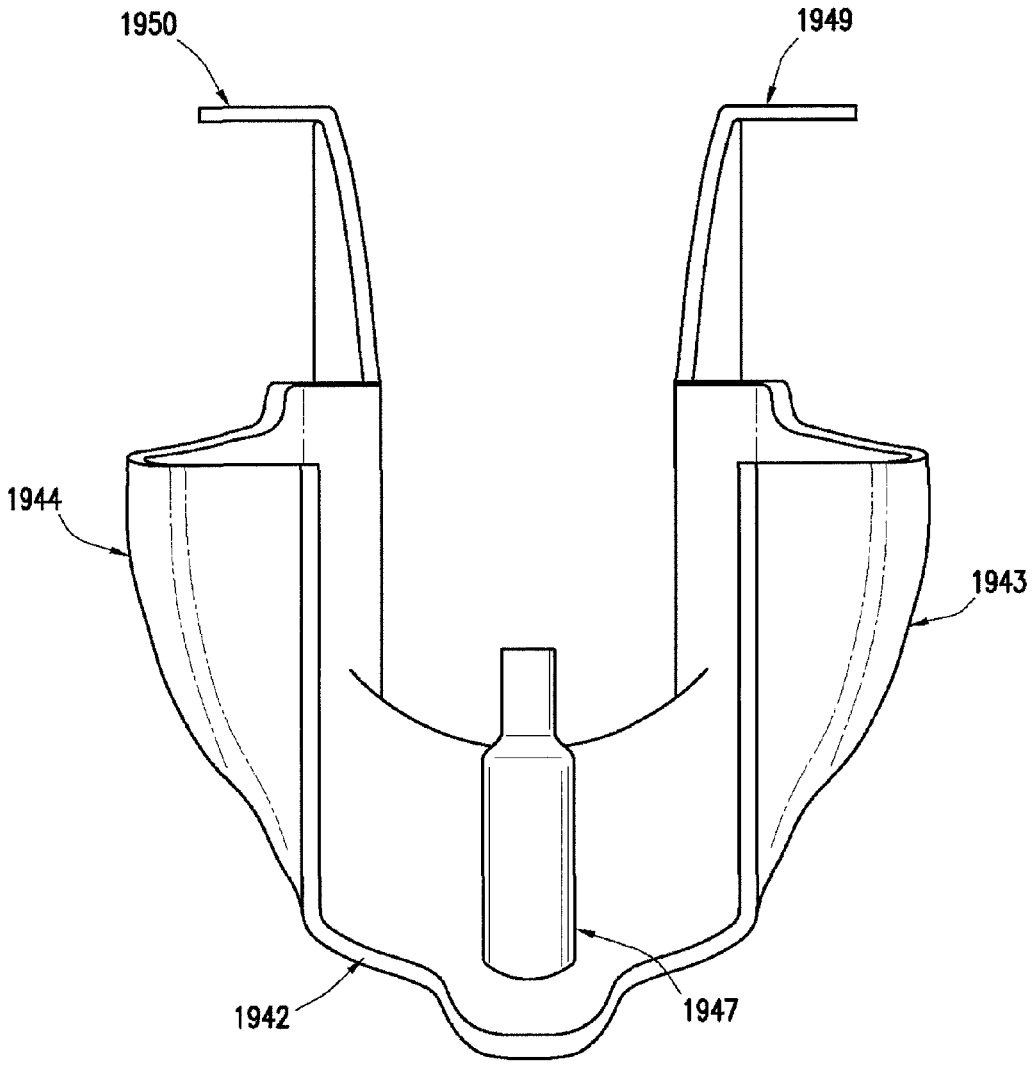

FIGS. 21A, 21B, and 21C illustrate different views of the example insulating tray 1940. Example insulating tray 1940 comprises a base 1941, a sloped portion 1942, and sides 1943 and 1944. Sloped portion 1942 is designed with a downward slope to allow water that may accumulate within the tray to run off the tray. Sides 1943 and 1944 of example insulating tray 1940 can comprise protrusions that correspond with the insulating rings 1970 disposed on the outer surface of the vacuum interrupter 1901. Sides 1943 and 1944 can also comprise vertical indentations 1945 and 1946 on each side. The vertical indentations 1945 and 1946 accommodate linkages 1964 and 1965 which extend from the actuator mechanism 1963 toward the top portion of the housing 1904 for opening and closing the vacuum interrupter 1901.

The example insulating tray 1940 further comprises flanges 1949 and 1950 which comprise apertures for fastening the tray to the top portion 1905 of housing 1904. One advantage to fastening the tray to the top portion 1905 of the housing 1904 is that the fasteners can be electrically connected to the closest end conductor entering the housing. It is preferable to have conductive elements, such as fasteners, fixed to one of the voltages of the end conductors.

Figure 22:
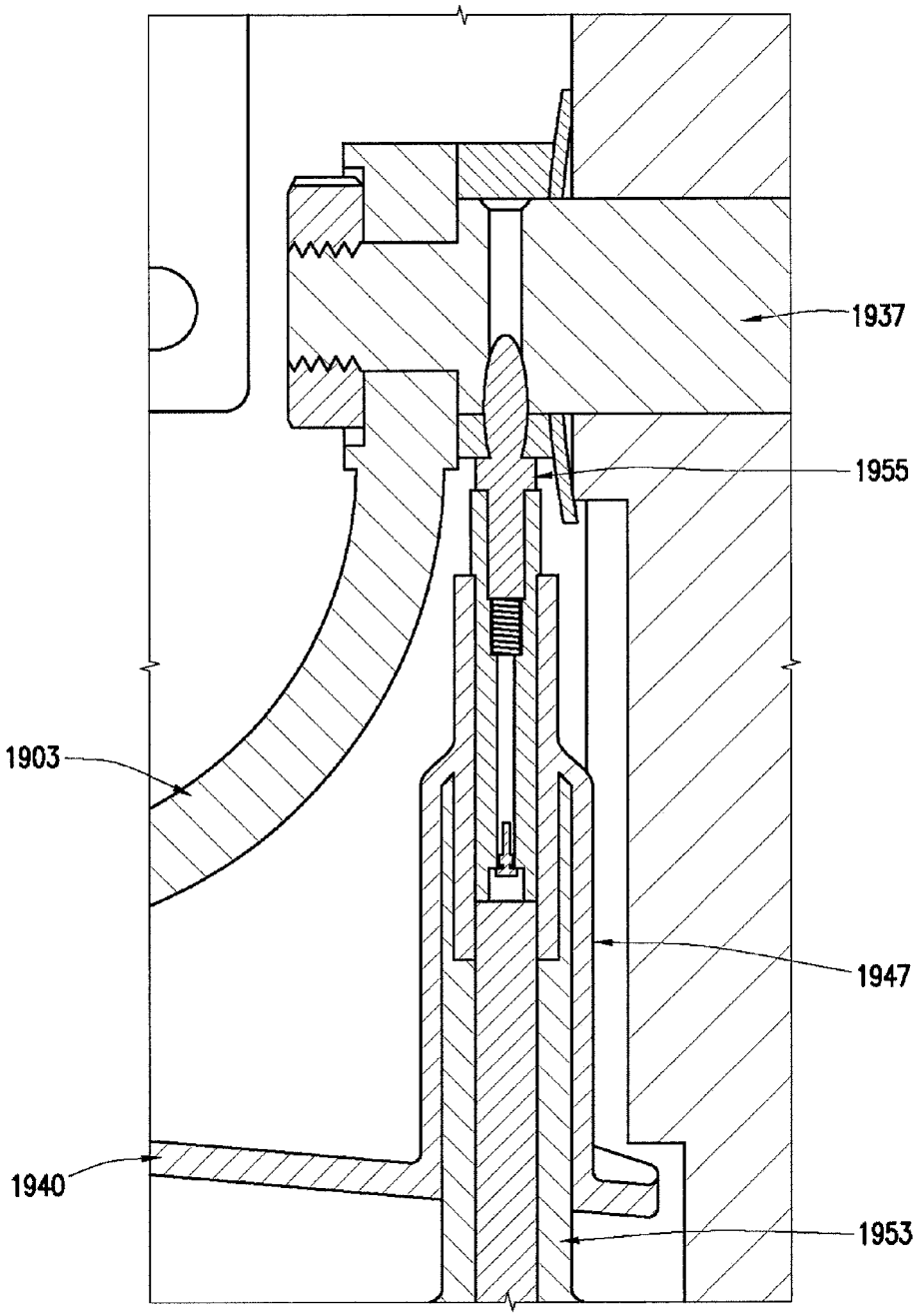
FIG. 22 illustrates a close up view of a voltage sensor in accordance with an example embodiment of the present disclosure.

Lastly, insulating tray 1940 comprises vertical extrusions 1947 and 1948 that are used to provide an interface between the voltage sensors 1952 and 1953 and the insulating tray 1940. A close up view of voltage sensor 1953 and vertical extrusion 1947 is shown in FIG. 22. As shown in FIG. 22, vertical extrusion 1947 receives a banana-style jack 1955 which connects to end conductor 1937. Readings from the voltage sensor 1953 can be transmitted to equipment located in the tank 1920. An insulated switchgear module can have a single voltage sensor located at one end conductor or can have a voltage sensor located at each end conductor. The improved insulating characteristics of the example insulated switchgear modules described herein minimize interference between two voltage sensors located within a module and therefore improve performance of the device.

As with other example insulating trays described herein, insulating tray 1940 may be made with any appropriate insulating material, for instance: thermosets, thermoplastics, elastomers, composites, ceramics, or glasses. Insulating tray 1940 may be made out of a composite material or polymeric blend or alloy, for instance, fibrous composites, laminated composites, particulate composites, or any combination of some or all of the aforementioned materials. Insulating tray 1940 may be made out of a pre-filled two-part cycloaliphatic epoxy.

Insulating tray 1940 offers several advantages over prior art switchgear. For example, the curved shape of insulating tray 1940 offers improved insulating characteristics in that it surrounds three sides of the vacuum interrupter 1901 thereby better insulating the vacuum interrupter from the other components of the insulated switchgear module 1900. Furthermore, insulating tray 1940 has a shape that corresponds with both the shape of the vacuum interrupter 1901 and the interior surface of the housing 1904, which also offers improved insulating characteristics.

Insulating tray 1940 shown in FIGS. 19-21 is one example embodiment. In alternate embodiments, the insulating tray can have alternate or additional features for mounting the insulating tray to the insulated switchgear module. For example, the insulating tray may not have the flanges or vertical extrusions shown in FIGS. 19-21, but instead may have tabs along the sides of the insulating tray for securing to the sides of the housing 1904. In yet other alternate embodiments, an additional insulating tray can be disposed between insulating tray 1940 and the tank 1920 to further enhance the insulating characteristics of the module.

In certain embodiments, the insulated switchgear module 1900 can be manufactured such that the housing 1904 is molded around the vacuum interrupter 1901. Once the insulated switchgear module 1900 is assembled, the cavity within insulated switchgear module 1900 can be placed under any pressure or can be filled with air or another insulating fluid. Although insulated switchgear module 1900 is shown with two end conductors embedded in air terminals, it should be understood that in the embodiment shown in FIG. 19 as well as the other embodiments described herein, one or both of the end conductors may terminate in underground cables. Furthermore, it should be understood that the example embodiments described herein can be applied to both indoor and outdoor environments.

It should be appreciated that aspects of the invention described above are by way of example only, and are not intended as required or essential elements of the invention unless explicitly stated otherwise. It should be understood that the invention is not restricted to the described and illustrated embodiments and that various modifications can be made within the scope of the description. For instance, the insulating layer 1878 of FIG. 18 may be combined with the modified housing 300" of FIG. 8 and the isolating barrier 1474 of FIG. 14. Likewise, while the figures show single-phase housings and interrupters, it can be envisioned that insulating housings 300 could also accommodate poly-phase, such as three-phase, systems by allowing additional end conductors, air terminations and interrupters. Likewise, multiple insulating housings 300 could be mounted on a larger tank 562.

In conclusion, the insulating system described above with respect to FIGS. 3 through 18 presents an improvement over insulation systems known in the prior art, presenting a robust, durable discharge-resistant device. It is modular, and allows choice of interrupter and sensor types to be made after manufacturing, replacement of damaged components without discarding the entire system, and reduces cross talk between sensors.

Although the inventions are described with reference to example embodiments, it should be appreciated by those skilled in the art that various modifications are well within the scope of the invention. From the foregoing, it will be appreciated that an embodiment of the present invention overcomes the limitations of the prior art. Those skilled in the art will appreciate that the present invention is not limited to any specifically discussed application and that the embodiments described herein are illustrative and not restrictive. From the description of the example embodiments, equivalents of the elements shown therein will suggest themselves to those skilled in the art, and ways of constructing other embodiments of the present invention will suggest themselves to practitioners of the art. Therefore, the scope of the present invention is not limited herein.

What is claimed is:

1. A switchgear insulation system comprising:

a current interrupter, the current interrupter comprising:

a moveable contact;

a stationary contact;

a shield surrounding the moveable contact and the stationary contact;

a cylindrical insulator surrounding the shield, the cylindrical insulator having a first end cap and a second end cap; and a secondary insulating layer surrounding the cylindrical insulator, the secondary insulating layer having a non-uniform thickness along the length of the cylindrical insulator, wherein the secondary insulating layer comprises a first end portion and a second end portion and wherein there is a gap where the secondary insulating layer has zero thickness between the first end portion and the second end portion.

2. The switchgear insulation system of claim 1, wherein the secondary insulating layer has a wave shaped surface.

3. The switchgear insulation system of claim 1, wherein the secondary insulating layer comprises a third portion between the first end portion and the second end portion, the third portion not in contact with either the first end portion or the second end portion.

4. The switchgear insulation system of claim 1, further comprising a barrier located between the first end portion and the second end portion.

5. The switchgear insulation system of claim 4, wherein the barrier extends from the cylindrical insulator to a housing on a first side of the current interrupter and from the cylindrical insulator to an insulating tray on a second side of the current interrupter.

6. The switchgear insulation system of claim 1, further comprising a plurality of barriers located between the first end portion and the second end portion.

7. A switchgear insulation system comprising:

a current interrupter, the current interrupter comprising:

a moveable contact a stationary contact a shield surrounding the moveable contact and the stationary contact;

a cylindrical insulator surrounding the shield, the cylindrical insulator having a first end cap and a second end cap; and a secondary insulating layer surrounding the cylindrical insulator, the secondary insulating layer having a non-uniform thickness along the length of the cylindrical insulator; and an insulating housing in which the current interrupter is disposed, the insulating housing comprising first insulating protrusions on an inside surface of the insulating housing, the first insulating protrusions extending towards the current interrupter.

8. The switchgear insulation system of claim 7, further comprising an insulating tray disposed proximate to the current interrupter, the insulating tray comprising second insulating protrusions extending towards the current interrupter.

9. An insulated switchgear module comprising:

an insulated housing;

at least two terminations, each termination configured to receive a conductor;

a current interrupter disposed within the insulated housing, the current interrupter comprising an insulating layer, the insulating layer having a non-uniform shape along its length;

an insulating tray defining a cavity, the current interrupter disposed within the cavity, the insulating tray having a non-uniform shape corresponding to the non-uniform shape of the insulating layer along the length of the current interrupter;

an actuator coupled to the current interrupter by at least one linkage; and a tank coupled to the insulating housing and forming an enclosure with the insulated housing.

10. The insulated switchgear module of claim 9, wherein the insulated housing has a non-uniform shape corresponding to the non-uniform shape of the insulating tray and the non-uniform shape along the length of the insulating layer of the current interrupter.

11. The insulated switchgear module of claim 9, further comprising at least one voltage sensor coupled to one of the conductors and coupled to the insulating tray.

12. The insulated switchgear module of claim 9, further comprising at least one current sensor disposed proximate to one of the at least two terminations.

13. The insulated switchgear module of claim 9, wherein the current interrupter is coupled to a current exchange assembly.

14. The insulated switchgear module of claim 13, wherein the current exchange assembly comprises a strap.

15. An insulated switchgear module comprising:

an insulated housing;

at least two terminations, each termination configured to receive a conductor;

an insulating tray disposed within the insulated housing, the insulating tray defining a cavity;

a current interrupter disposed within the cavity of the insulating tray, the current interrupter comprising an insulating layer, the insulating layer having a non-uniform shape along its length;

an actuator coupled to the current interrupter by at least one linkage; and a tank coupled to the insulating housing and forming an enclosure with the insulated housing.

16. The insulated switchgear module of claim 15, wherein the actuator is coupled to the current interrupter by a first linkage and a second linkage, the first linkage passing along one side of the insulating tray and the second linkage passing along another side of the insulating tray.

17. The insulated switchgear module of claim 15, further comprising an intermediate plate disposed between the insulating tray and the tank, wherein the actuator passes through the intermediate plate.

18. The insulated switchgear module of claim 15, wherein the tank further comprises a window opening proximate to an indicator.

19. The insulated switchgear module of claim 9, wherein the insulating layer comprises a first end portion and a second end portion and wherein there is a gap where the insulating layer has zero thickness between the first end portion and the second end portion.

20. The insulated switchgear module of claim 19, wherein the insulating layer comprises a third portion between the first end portion and the second end portion, the third portion not in contact with either the first end portion or the second end portion.

21. The insulated switchgear module of claim 19, further comprising a barrier located between the first end portion and the second end portion.

22. The insulated switchgear module of claim 9, wherein the insulated housing further comprises first insulating protrusions on an inside surface of the insulated housing, the first insulating protrusions extending towards the current interrupter.

23. The insulated switchgear module of claim 9, the insulating tray comprising second insulating protrusions extending towards the current interrupter.

24. The insulated switchgear module of claim 15, wherein the insulating layer comprises a first end portion and a second end portion and wherein there is a gap where the insulating layer has zero thickness between the first end portion and the second end portion.

25. The insulated switchgear module of claim 24, wherein the insulating layer comprises a third portion between the first end portion and the second end portion, the third portion not in contact with either the first end portion or the second end portion.

26. The insulated switchgear module of claim 24, further comprising a barrier located between the first end portion and the second end portion.

27. The insulated switchgear module of claim 15, wherein the insulated housing further comprises first insulating protrusions on an inside surface of the insulated housing, the first insulating protrusions extending towards the current interrupter.

28. The insulated switchgear module of claim 15, the insulating tray comprising second insulating protrusions extending towards the current interrupter.

* * * * *